United States Patent [19]

Nishimura et al.

[11] 4,433,918

[45] Feb. 28, 1984

[54] ANALOG DISPLAY ELECTRONIC TIMEPIECE WITH MULTI-MODE DISPLAY CAPABILITY

[75] Inventors: Katsuo Nishimura; Fukuo Sekiya, both of Tokorozawa, Japan

[73] Assignee: Citizen Watch Company Limited, Tokyo, Japan

[21] Appl. No.: 281,157

[22] Filed: Jul. 7, 1981

[30] Foreign Application Priority Data

| | | | |
|---|---|---|---|
| Jul. 18, 1980 | [JP] | Japan | 55-98326 |
| Oct. 9, 1980 | [JP] | Japan | 55-141464 |
| Oct. 13, 1980 | [JP] | Japan | 55-141958 |

[51] Int. Cl.[3] ..... G04B 23/02

[52] U.S. Cl. ..... 368/74; 368/185; 368/187; 368/220

[58] Field of Search ..... 368/76, 80, 88, 155, 368/157, 160, 220, 319-321, 69, 70, 187, 190, 72, 73, 74, 250, 251, 249, 259, 260

[56] References Cited

U.S. PATENT DOCUMENTS

| | | | |
|---|---|---|---|
| 4,223,522 | 9/1980 | Nomura et al. | 368/80 |
| 4,223,523 | 9/1980 | Kamijo | 368/72 |
| 4,253,172 | 2/1981 | Nomura | 368/72 |
| 4,357,693 | 11/1982 | Placon et al. | 368/187 |

*Primary Examiner*—Bernard Roskoski

*Attorney, Agent, or Firm*—Jordan and Hamburg

[57] ABSTRACT

An electronic timepiece of analog display type is provided with at least one other additional function mode such as an alarm mode in addition to a current time mode of operation. When changeover from one function mode to another is performed, by actuation of an external operating member, information indicated by the timepiece analog display is rapidly changed over to correspond to information for the new function mode, e.g. is rapidly changed over to indicate an alarm time when changeover from the current time mode to the alarm time mode is performed, and rapidly changed to indicate current time when the reverse mode changeover is performed.

7 Claims, 19 Drawing Figures

50
25
23
52
SETTING PULSE GENERATING CIRCUIT
CONTROL CIRCUIT
26
28
33
STANDARD FREQUENCY SIGNAL SOURCE
FREQUENCY DIVIDER
SECONDS HAND POSITION CALCULATION CIRCUIT
64
SECONDS COUNTER CIRCUIT
30
31
CURRENT TIME POSITION CALCULATION CIRCUIT (A)
66
62
MAIN COUNTER CIRCUIT
34
56
CURRENT TIME AND ALARM TIME POSITION CALCULATION CIRCUIT (B)
AUXILIARY COUNTER CIRCUIT
54

FROM 50
83
84
TO 32
31 OR MORE (FORWARD ROTATION)
64
TO 34
88
92
H: FORWARD ROTATION
L: REVERSE ROTATION
"0" OUT
JAM IN
DOWN COUNTER
DATA
φ
82
33
SELECTOR CIRCUIT
86
COMPLEMENT GENERATING CIRCUIT
"31 OR MORE" DISCRIMINATION CIRCUIT
90
31

FROM FREQUENCY DIVIDER 28
62
30 OR LESS (REVERSE ROTATION)

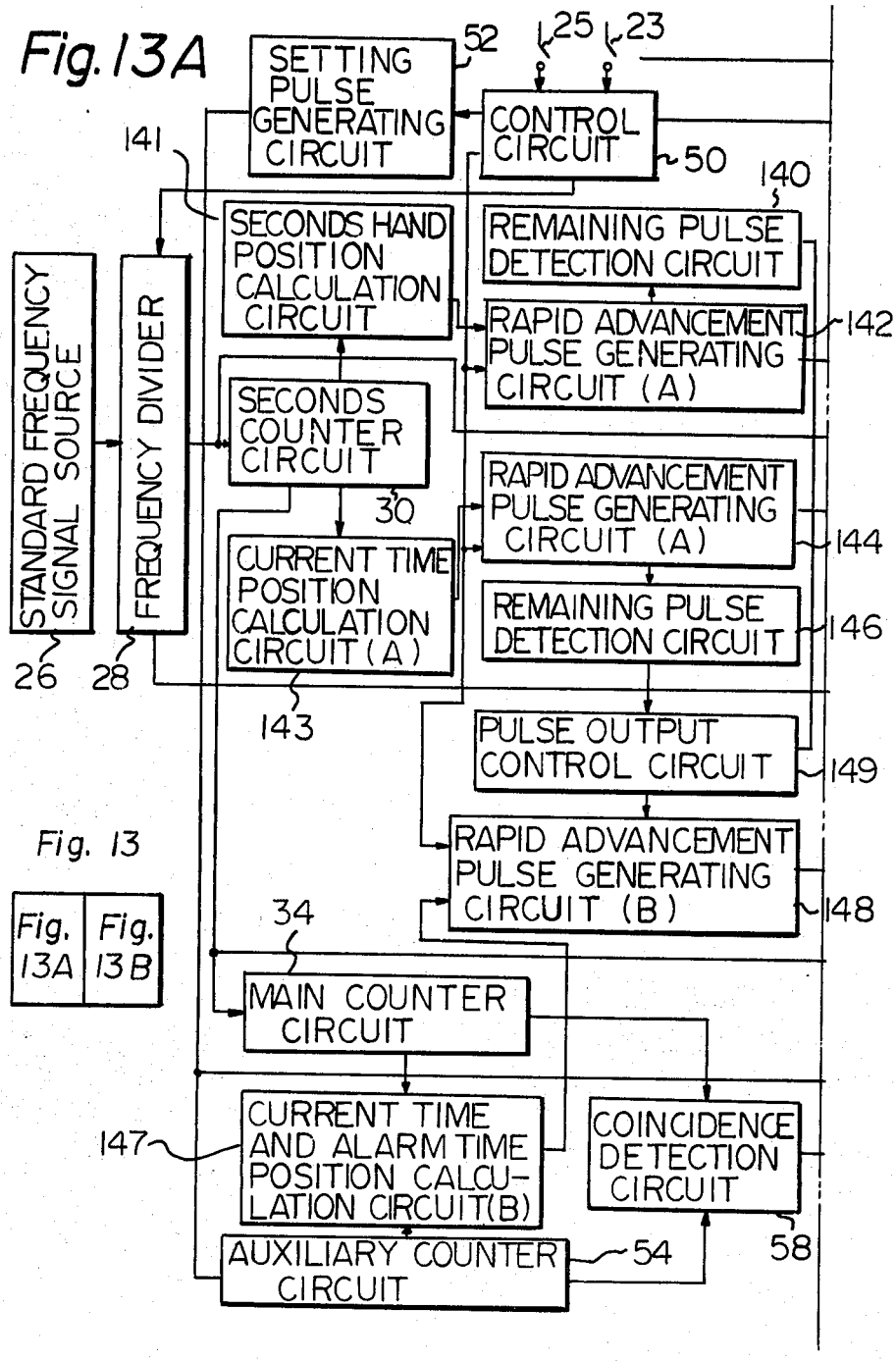
Fig. 13A
SETTING PULSE GENERATING CIRCUIT
52
25
23
CONTROL CIRCUIT
50
141
140
SECONDS HAND POSITION CALCULATION CIRCUIT
REMAINING PULSE DETECTION CIRCUIT
RAPID ADVANCEMENT PULSE GENERATING CIRCUIT (A)
142
STANDARD FREQUENCY SIGNAL SOURCE
FREQUENCY DIVIDER
SECONDS COUNTER CIRCUIT
30
RAPID ADVANCEMENT PULSE GENERATING CIRCUIT (A)
144
CURRENT TIME POSITION CALCULATION CIRCUIT (A)
REMAINING PULSE DETECTION CIRCUIT
146
26
28
143
PULSE OUTPUT CONTROL CIRCUIT
149
Fig. 13
RAPID ADVANCEMENT PULSE GENERATING CIRCUIT (B)
148
Fig. 13A
Fig. 13B
34
MAIN COUNTER CIRCUIT
147
CURRENT TIME AND ALARM TIME POSITION CALCULATION CIRCUIT(B)
COINCIDENCE DETECTION CIRCUIT
AUXILIARY COUNTER CIRCUIT
54
58

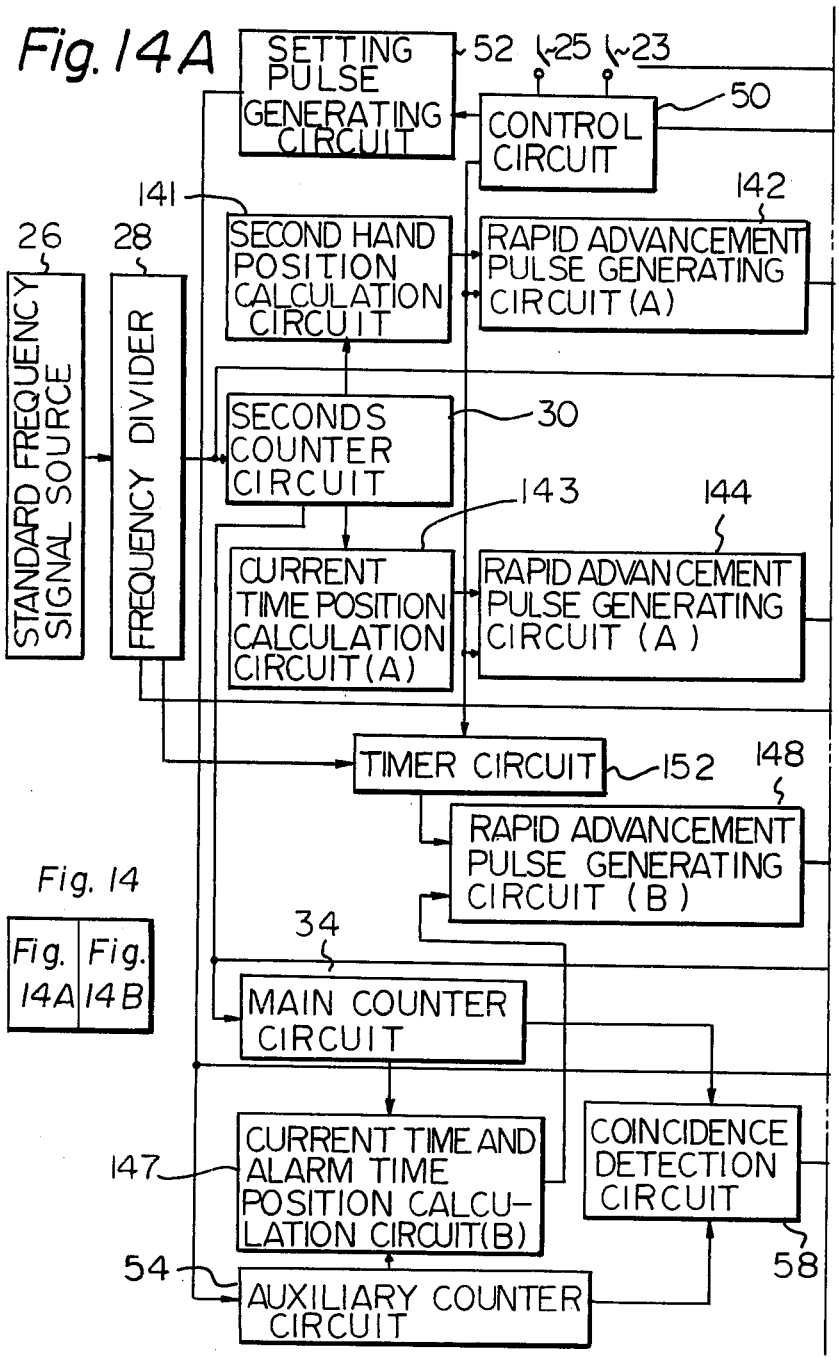
Fig. 14A
SETTING PULSE GENERATING CIRCUIT
52
25
23
CONTROL CIRCUIT
50
141
142
26
28
SECOND HAND POSITION CALCULATION CIRCUIT
RAPID ADVANCEMENT PULSE GENERATING CIRCUIT (A)
STANDARD FREQUENCY SIGNAL SOURCE
FREQUENCY DIVIDER
SECONDS COUNTER CIRCUIT
30
143
144
CURRENT TIME POSITION CALCULATION CIRCUIT (A)
RAPID ADVANCEMENT PULSE GENERATING CIRCUIT (A)
TIMER CIRCUIT
152
148
RAPID ADVANCEMENT PULSE GENERATING CIRCUIT (B)
Fig. 14
Fig. 14A
Fig. 14B
34
MAIN COUNTER CIRCUIT
147
CURRENT TIME AND ALARM TIME POSITION CALCULATION CIRCUIT (B)
COINCIDENCE DETECTION CIRCUIT
58
54
AUXILIARY COUNTER CIRCUIT

ALARM ON/OFF MEMORY CIRCUIT
27

32
CHANGEOVER CONTROL CIRCUIT(A)
36
38
ELECTRO-MECHANICAL TRANSDUCER(A)
WHEEL TRAIN(A)
150
WAVEFORM SHAPING AND DRIVE CIRCUIT
14
16
18
12
40
CONTROL CHANGEOVER CIRCUIT (B)
ELECTRO-MECHANICAL TRANSDUCER(B)
WHEEL TRAIN(B)
44
46
ALARM UNIT 60

ANALOG DISPLAY ELECTRONIC TIMEPIECE WITH MULTI-MODE DISPLAY CAPABILITY

BACKGROUND OF THE INVENTION

The present invention relates to an electronic timepiece of analog display type, provided with a plurality of function modes, e.g. a normal timekeeping mode and an alarm time mode. It should be noted that the term "analog display" as used in the present specification and the appended claims is used for brevity of description to refer to a timepiece display of conventional type having time indicating hands and a dial.

At present, electronic timepieces using a quartz crystal controlled oscillator circuit as a standard frequency signal source are in wide use. These are either of analog display type or digital display type. The analog display electronic timepiece has tended to become of very high accuracy and of slim and elegant shape. The digital display electronic timepiece, on the other hand, has increasingly tended to offer a multiplicity of function modes, e.g. an alarm mode, stopwatch mode, elapsed time mode, etc. Such function modes can be easily and conveniently provided with such digital timepieces because the liquid crystal displays generally used at present, for digital display timepieces, can be rapidly switched over from displaying one set of information to displaying some other set of information.

It would be desirable to be able to combine the attractive characteristics of an analog display electronic timepiece with a capability for immediate changeover among a plurality of different function modes, such as is possible with a digital display timepiece. However, this has not been achieved on a practical basis, up to the present, for a number of reasons. One of these reasons is due to the basic nature of the means whereby the time indicating hands of an analog display electronic timepiece are driven, i.e. by an electromechanical transducer (e.g. a stepping motor) acting through a gear train. If changeover is performed between one function mode and another, e.g. from the normal timekeeping mode in which current time is displayed to an alarm time mode in which a preset alarm time is displayed, then it is necessary to rapidly change all of the time indicating hands from one set of positions to another set of positions. This could be accomplished relatively rapidly for the seconds hand. However, because of the speed reduction provided by the wheel train of the timepiece, a relatively long time would be required for the hours and minutes hands to be changed to new positions.

The latter problem can be substantially overcome by using a plurality of electromechanical transducers to drive the hands, e.g. one stepping motor to drive the seconds hand and another to independently drive the hours and minutes hands. Such a solution would normally result in an increased drain of battery current, when all of the timekeeping hands are being simultaneously rotated to new positions, thereby requiring a larger size of timepiece battery. In addition, use of two electromechanical transducers would normally require the number of drive inverters used to drive these transducers being doubled. This is an important point, since these drive inverters substantially dictate the overall size of the integrated circuit used in an analog display electronic timepiece. However, as described in the specification, the present invention enables such problems which have arisen with prior art methods of using a plurality of electromechanical transducers to drive the hands of an analog display electronic timepiece to be substantially eliminated.

Another difficulty which arises in providing a multiple mode changeover capability with an analog display electronic timepiece lies in the problem of how to provide a positive indication to the timepiece user that changeover from one function mode to another has been accomplished. With a digital display timepiece, this can be easily implemented by means of specific symbols or markers which are activated to indicate the currently selected function mode. With an analog display electronic timepiece, however, such means are not available. This problem is overcome, with an analog display electronic timepiece according to the present invention, by causing the timepiece hands to move in a predetermined manner to indicate function mode information. For example, when change over is performed between a current time display mode and an alarm mode, the seconds hand of the timepiece can be made to go rapidly to the zero seconds position, and remain at that position. To indicate that the timepiece alarm is set to the ON state, so that an audible alarm signal will be generated, the seconds hand (or another hand) can be made to vibrate back and forth.

In addition, as described in detail hereinafter, the present invention teaches circuit means whereby, when changeover from one function mode to another is performed, information designating the new positions which the hands must take up is immediately generated, and applied to the drive circuits actuating the electromechanical transducer or transducers of the timepiece. It is an important feature of the present invention that the latter hands position information generating circuit means are extremely simple, and can easily be combined with other circuitry of the timepiece.

An analog display electronic timepiece having a plurality of function modes, according to the present invention, can therefore be easily designed and manufactured on a practical basis, and will combine the advantageous features provided by such a timepiece in the prior art with the advantages of a function mode selection capability which has hithereto been available only with digital display electronic timepieces.

SUMMARY OF THE INVENTION

The present invention comprises an analog display electronic timepiece having a plurality of function modes. In addition to the means for producing a time signal to periodically actuate an electromechanical transducer (e.g. a stepping motor) through a drive circuit, to rotate time indicating hands, an analog display electronic timepiece according to the present invention is also provided with a main counter circuit which can be reset to a predetermined count, e.g. zero, at an arbitrary time by the user, through actuation of a switch, and thereafter periodically be incremented in synchronism with advancement of the time indicating hands, an auxiliary counter circuit in which information relating to a function mode other than the current timekeeping function can be stored, and a calculation circuit which is coupled to receive the contents of both the main and the auxiliary counter circuit. Each time a changeover is performed from one function mode (e.g. that in which the current time is displayed by the hands) to another function mode (e.g. one in which an alarm time corresponding to the contents of the auxiliary counter circuit is to be indicated by the hands), signals are produced by the calculation circuit, based on the contents of the main and auxiliary counter circuits, whereby the hands of the timepiece are rotated rapidly to the appropriate positions for the newly selected function mode.

In addition, if the timepiece is provided with a seconds hand, then the way in which the seconds hand moves, upon a transition from one function mode to another, can serve as an indication of the newly selected function mode. For example, as described by the embodiments hereinafter, the seconds hand can be made to immediately return to the zero seconds (i.e. 12 o-clock) position when a changeover is made from the current time function mode to the alarm time function mode. Furthermore, in the alarm time function mode, the seconds hand can be made to either remains stationary or to vibrate back and forth, in accordance with whether the timepiece is currently in the alarm on or alarm off state.

It is also possible with an analog display electronic timepiece according to the present invention, as described hereinafter, to provide means whereby the contents of the main counter and/or the auxiliary counter are only incremented when the stepping motor actuating the time indicating hands is fully driven through a complete rotation. It is possible, particularly with an ultra-miniatuare stepping motor, for the rotor of the motor to occasionally fail to be fully rotated in response to a drive pulse, due to some reason such as pickup of external interference, etc. This could cause the contents of the main counter or of the auxiliary counter to fail to correspond with a current time or alarm time indicated by the hands of the timepiece, so that an alarm indication, for example, might be emitted at a different time from that indicated. However, with the present invention, as stated above, it is possible to avoid such a problem, by arranging that incrementing of the main and auxiliary counter circuits is made dependent upon satisfactory operation of the stepping motor.

DESCRIPTION OF THE PREFERRED EMBODIMENTS

Figure 1:
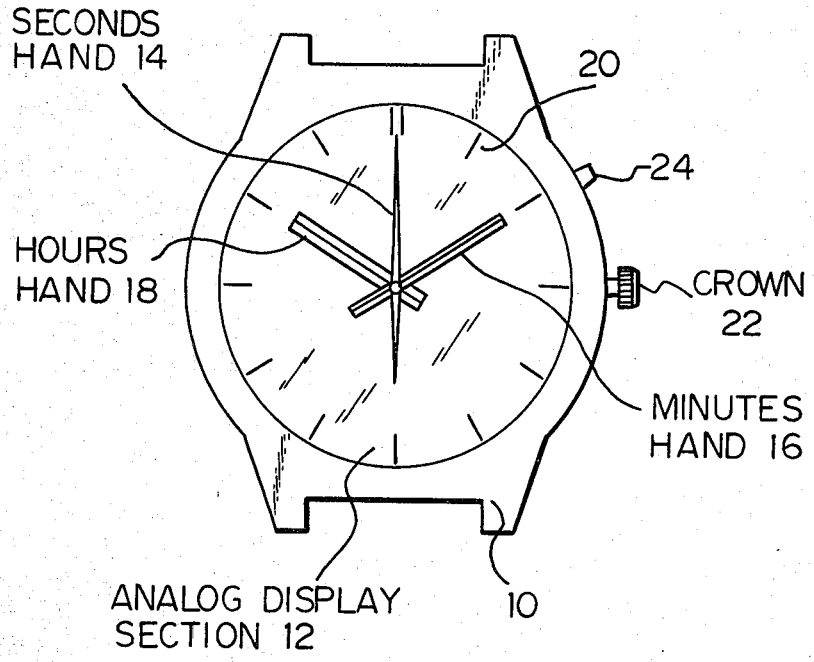
FIG. 1 is a plan view of the exterior of an embodiment of analog display electronic timepiece according to the present invention.

Referring now to the attached drawings, FIG. 1 is a plan view of the exterior of an embodiment of an analog display electronic timepiece according to the present invention. Numeral 10 denotes a case, and numeral 12 an analog display section comprising a seconds hand 14, a minutes hand 16 and hours hand 18, together with a dial plate 20. Numeral 22 denotes a rotatable external operating member, i.e. a crown. In addition to being rotatable in clockwise and counterclockwise directions, crown 22 can be pulled out axially from a normal inward position shown in FIG. 1 to a first outward position, and furthermore to a second outward position, beyond the first outward position. Switch means are coupled to crown 22 and responsive to rotational and axial movement thereof as described hereinafter. Numeral 24 denotes an external operating member which is also coupled to switch means, the latter switch means being responsive to depression of member 24 for generating switching signals, as described hereinafter.

Figures 2, 2A, 2B:
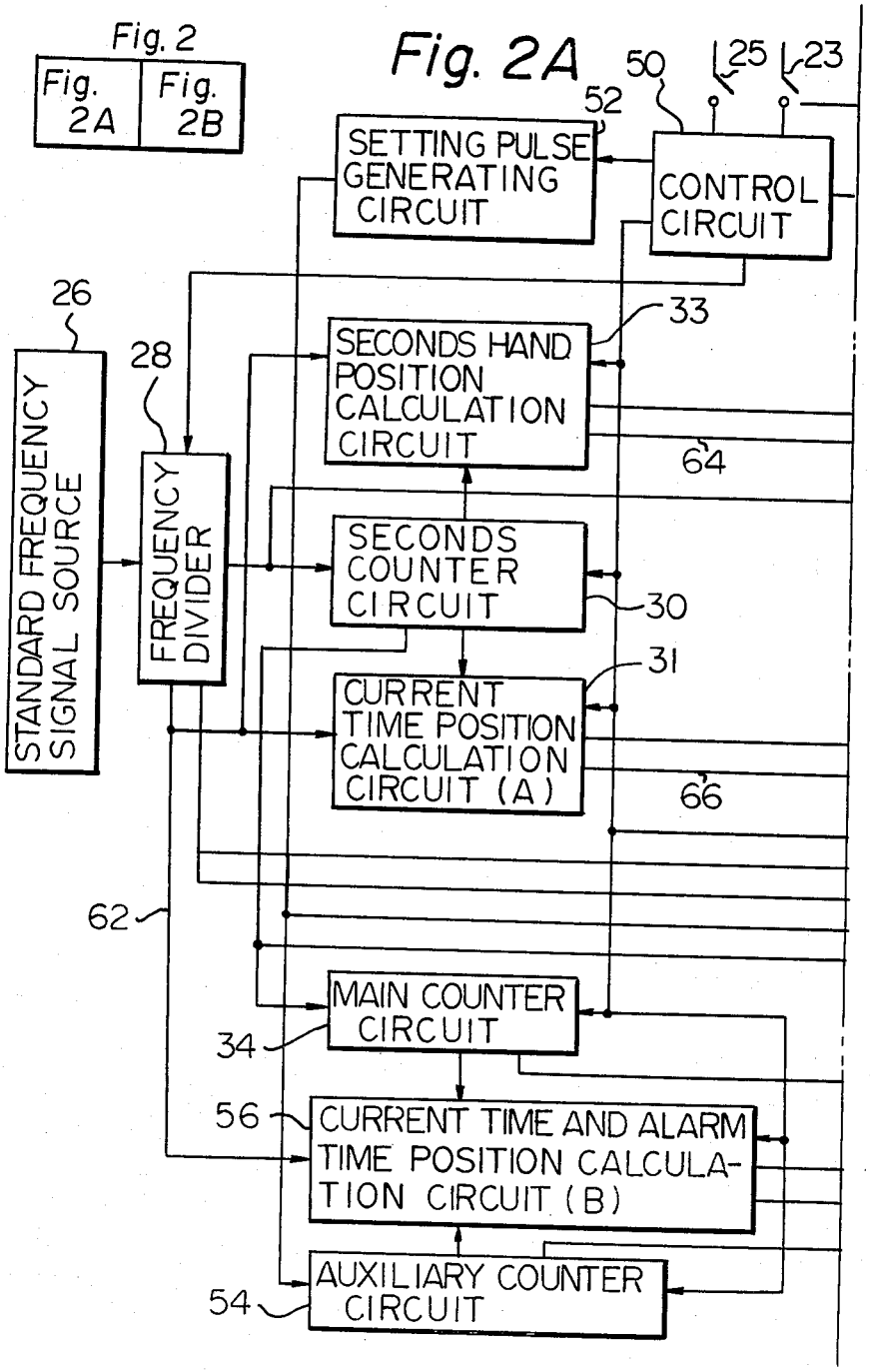
FIG. 2 is a block circuit diagram of an embodiment of an analog display electronic timepiece according to the present invention, having three time indicating hands, whereby an alarm ON/OFF status is indicated by vibration of a seconds hand.
Figure 2B:
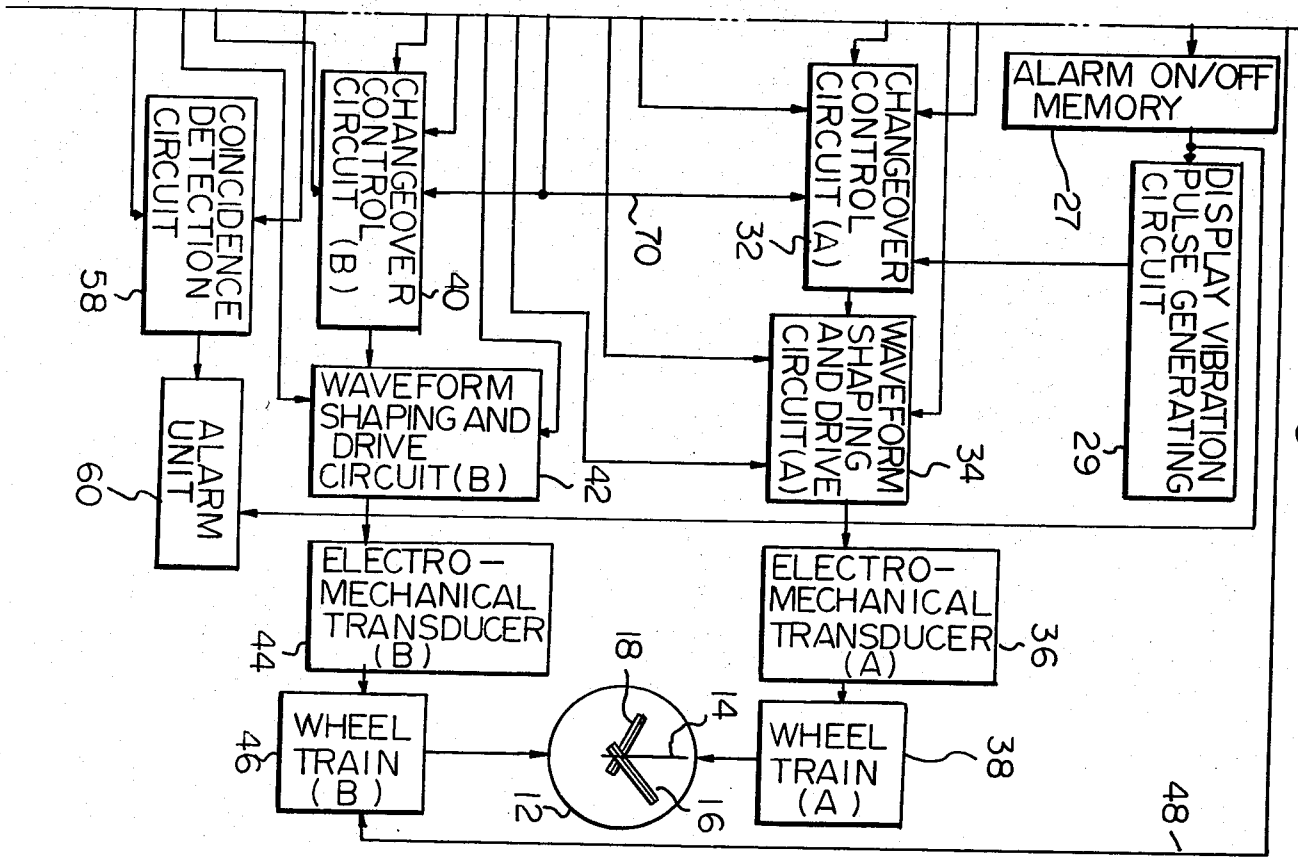

Referring now to FIG. 2, a block circuit diagram is shown therein of an embodiment of an analog display electronic timepiece according to the present invention, whose external appearance can be as illustrated in FIG. 1. In this embodiment, separate means are provided for driving the seconds hand 14 and for driving the minutes and hours hands 16 and 18, respectively. Components and circuit blocks associated with driving the seconds hand 14 are designated by the suffix (A) in FIG. 2, while components and circuit blocks associated with driving the minutes and hours hands 16 and 18 are designated by the suffix (B), for ease of comprehension.

Numeral 26 denotes a standard frequency signal source for producing a standard frequency signal, and comprising an ultra-miniature quartz crystal vibrator in conjunction with an oscillator circuit. The output from standard frequency signal source 26 has a frequency which is a multiple of $2^n$, for example 32 KHz, or 4 MHz. Numeral 28 denotes a frequency divider circuit which is coupled to perform frequency division of the output from standard frequency signal source 26, to produce a unit time signal having a period of one second, and also various clock pulse signals. The unit time signal is input to a seconds counter circuit 30 and also to a changeover control circuit (A) denoted by numeral 32. The timepiece can operate in two function modes, i.e. a current time mode and an alarm time mode. In the current time mode, the current time is indicated by analog display section 12, while in the alarm time mode, the minutes and hours of a preset alarm time are indicated by analog display section 12. In the current time mode, changeover control circuit (A) 32 transfers the unit time signal from frequency divider circuit 28 to a waveform shaping and drive circuit (A) denoted by numeral 34. Drive signals are thereby produced from this waveform shaping and drive circuit and applied to an electromechanical transducer (A) denoted by numeral 36, which would typically comprise a sub-miniature stepping motor. The resultant periodic rotation of a rotor of electromechanical transducer (A) 36 is thereby transmitted through a wheel train (A) 38, to advance the seconds hand 14, once per second. Each time changeover between the current time and the alarm time mode is performed pulses are generated as described hereinafter to drive the timepiece hands to appropriate positions, by calculation and counter circuit means comprising a main counter circuit 34, an auxiliary counter circuit 54, and a current time and alarm time position calculation circuit (B) 56.

The seconds counter circuit 30 produces an output pulse once every 20 seconds, which is applied to main counter circuit 34 and also to a changeover control circuit (B) denoted by numeral 40. In the current time mode, the output signal from seconds counter circuit 30 is transferred by changeover control circuit (B) 40 to waveform shaping and drive circuit (B) 42, from which drive signals are produced and applied to an electromechanical transducer (B) 44. Periodic rotation of a rotor of this electromechanical transducer is transmitted through a wheel train (B) 46 to thereby advance minutes hand 16 once every 20 seconds, i.e. three times per minute, and also to drive hours hand 18. The output signal from seconds counter circuit 30 is also input to a zero position calculation circuit 33 and also to a current time position calculation circuit (A) 31. Numeral 54 denotes an auxiliary counter circuit, which serves to count and store a preset alarm time. Both main counter circuit 34 and auxiliary counter circuit 54 have a maximum count corresponding to 12 hours, i.e. each counts on a 12-hour cycle, since analog display 12 also operates on a 12-hour cycle. The contents of auxiliary counter circuit 54 and of main counter circuit 34 are applied to a current time and alarm position calculation circuit (B) 56. Each time changeover is performed between the current time mode and the alarm time mode, pulses produced by current time position calculation circuit (A) 31 are transferred by changeover control circuit (B) 40 to waveform shaping and drive circuit (B) 42, to thereby drive the hours and minutes hands 16 and 18 to appropriate positions, as described in detail hereinafter. A coincidence dtection circuit 58 serves to detect coincidence between the contents of main counter circuit 34 and auxiliary counter circuit 54, i.e. between a count value in main counter circuit 34 which is incremented three times per minute and a preset alarm time held in auxiliary counter circuit 54. When such coincidence occurs, a coincidence detection signal is produced, and transferred to an alarm unit 60, which is thereby actuated to emit an audible alarm signal.

Numeral 33 denotes a seconds hand calculation circuit which serves to return the seconds hand 14 to the 12 o-clock position shown in FIG. 2, which will be referred to herein as the zero position. Each time changeover is performed from the current time mode to the alarm function mode, a group of pulses at a repetition rate higher than 1 Hz, referred to herein as rapid advancement pulses, are generated by seconds hand position calculation circuit 33 and transferred by changeover control circuit (A) 32 to waveform shaping and drive circuit (A) 34, whereby the seconds hand 14 is rapidly driven to the zero position. Similarly, when changeover is performed from the alarm time mode to the current time mode, rapid advancement pulses are generated by current time position calculation circuit (A) 31, which are transferred by waveform shaping and drive circuit (A) 32 to waveform shaping and drive circuit (A) 34, whereby seconds hand 14 is rapidly driven to the appropriate position for indicating the current time seconds information.

Both of electromechanical transducer (A) 36 and electromechanical transducer (B) 44 in the present embodiment are reversible. In other words, each has a rotor which can be selectively rotated in a forward and in a reverse direction. Determination of the direction of rotation is performed by waveform shaping of the drive pulses applied to these electromechanical transducers, carried out by waveform shaping and drive circuit (A) 34 and waveform shaping and drive circuit (B) 42. Such methods of producing reversible rotation of the rotor of an electro-mechanical transducer e.g. a miniature stepping motor are now well known in the art. Thus, when changeover is performed between the current time mode and the alarm time mode, control of the direction of rotation of electromechanical transducer (A) 36 is provided by means of a control signal referred to herein as a rotation direction designating signal applied over a line 64 from zero position calculation circuit 33 to waveform shaping and drive circuit (A) 34. Similarly, when changeover is performed from the alarm time mode to the current time mode, control of the direction of rotation of electro-mechanical transducer (A) 36 is provided by means of a rotation direction designating signal applied over a line 66 from current time position calculation circuit (A) 31 to waveform shaping and drive circuit (A) 34. In addition, control of the direction of rotation of electromechanical transducer (B) 44 when changeover is performed between the current time mode and the alarm time mode is performed by a rotation direction designating control signal applied over a line 68 from current time and alarm time position calculation circuit (B) 56 to waveform shaping and drive circuit (B) 42.

Numeral 23 denotes a switch mechanism which is actuated by crown 22 shown in FIG. 1, to produce various signals in accordance with rotation and axial movement of crown 22. A control circuit 50 is responsive to the latter signals from switch mechanism 23 for producing control signals to direct the operation of the various circuit blocks as described hereinafter. A setting pulse generating circuit 52 is responsive to signals produced by control circuit 50 when crown 22 is rotated, for producing successive setting pulses. These setting pulses are used to increment the contents of auxiliary counter circuit 54, i.e. to set in a desired alarm time, and also are applied through changeover control circuit (B) 40 to waveform shaping and drive circuit (B) 42 to drive electromechanical transducer (B) 44 to indicate the alarm time being set in.

Numeral 25 denotes a switch which is coupled to external operating member 24. Actuation of switch 25 causes signals to be generated by control circuit 50 whereby an alarm ON/OFF memory circuit 27 can be set selectively to an alarm on state and an alarm off state, i.e. states in which an output signal from the memory circuit 28 either enables or inhibits generation of an audible alarm signal by alarm unit 60. Alarm unit 60 comprises an electro-acoustic transducer such as a miniature electro-magnetic loudspeaker or piezo-electric buzzer, in combination with a driver circuit controlled by the coincidence detection signal from coincidence detection circuit 58.

Numeral 29 denotes a display vibration pulse generating circuit, which produces signals, transferred by changeover control circuit (A) 32 to waveform shaping and drive circuit (A) 34, whereby seconds hand 14 is driven into a state of vibration when the timepiece is in the alarm time mode and when the alarm ON/OFF memory circuit is in the alarm on state. The user is thereby notified as to whether the alarm on or alarm off status has been selected by actuation of switch 25.

The changeover control circuit (A) 32 and changeover control circuit (B) 40 perform selection of the signals which are to be applied to waveform shaping and drive circuit (A) 34 and to waveform shaping and drive circuit (B) respectively, in accordance with control signals produced by control circuit 50 as determined by actuation of switch mechanism 25. These control signals from control circuit 50 are transmitted over lines denoted by numeral 70 in FIG. 2. When changeover is performed from one function mode to another then, as stated above, rapid advancement pulses are produced by zero position calculation circuit 33, current time position calculation circuit (A) 31, and current time and alarm time position calculation circuit (B) 56. These pulses are produced utilizing clock pulse signals applied from frequency divider circuit 28 over a signal line 62.

The operation of the embodiment of FIG. 2 is as follows. In the current time mode, crown 22 is in the normal inward position shown in FIG. 1, and control signals produced by control circuit 50 cause the output signal from seconds counter circuit 30 to be transferred by changeover control circuit (B) 40 to waveform shaping and drive circuit (B) 42, to cause advancement of the hours and minutes of current time indicated by analog display section 12. In this mode, electromechanical transducer (B) 44 rotates in the forward direction. At the same time, the output signal from frequency divider circuit 28, the unit time signal, is transferred to waveform shaping and drive circuit (A) 34, so that seconds hand 14 is advanced once per second. The output signal from seconds counter circuit 30 is also input to main counter circuit 34, so that count therein is incremented in synchronism with advancement of the hours and minutes displayed by analog display section 12, i.e. once every 20 seconds.

If crown 22 is now pulled out to the first outward position, then a group of rapid advancement pulses is generated by current time and alarm time position calculation circuit (B) 56, which is transferred through changeover control circuit (B) 40 to waveform shaping and drive circuit (B) 42, whereby the minutes hand 16 and hours hand 18 are rotated into positions corresponding to a preset alarm time contained in auxiliary counter circuit 54. Rotation of hands 16 and 18 into the appropriate positions is performed by rotation of electromechanical transducer (B) 44 in either the forward or the reverse direction, such as to ensure maximum rapidity of establishing the new hands positions, with the direction of rotation being designated by a rotation direction designating signal applied over line 68 to waveform shaping and drive circuit (B) 42 from current time and alarm time position calculation circuit (B) 56. With crown 22 in the first outward position, rotation thereof in the counterclockwise direction causes control circuit 50 to generate signals whereby setting pulses are produced by setting pulse generating circuit 52. Normally, one pulse is produced by setting pulse generating circuit 52 for each "click" made as crown 22 is rotated. However, if crown 22 is rotated sufficiently rapidly, then control circuit 50 causes setting pulse generating circuit 52 to produce setting pulses at a rate of 64 Hz, so that rapid advancement of the alarm time can be carried out if required. These setting pulses are input to auxiliary counter circuit, to thereby increment the present alarm time as required. At the same time, the setting pulses are transferred by changeover control circuit (B) 40 to waveform shaping and drive circuit (B) 42, whereby the alarm time indicated by analog display section 12 is incremented in synchronism with incrementing of the contents of auxiliary counter circuit 54. Thus, the alarm time indicated by analog display section 12 will remain in correspondence with the contents of auxiliary counter circuit 54.

When changeover is performed from the current time to the alarm time mode as described above, then transfer of the unit time signal by changeover control circuit (A) 32 to waveform shaping and drive circuit (A) 34 is interrupted, and a group of pulses is generated by seconds hand position claculation circuit 33 and transferred by changeover control circuit (A) 32 to waveform shaping and drive circuit (A) 34, whereby seconds hand 14 is rapidly driven to the zero position. This indicates to the user that the alarm time mode has been entered. Subsequently, when crown 22 is returned from the first outward position to the inward position, to thereby re-enter the current time mode, a group of pulses is produced by current time position calculation circuit (A) 31 and transferred by changeover control circuit (A) 32 to waveform shaping and drive circuit (A) 34, whereby seconds hand 14 is rapidly rotated to the current time seconds position. At the same time, a group of pulses is generated by current time and alarm time position calculation circuit (B) 56 and transferred through changeover control circuit (B) 40 to waveform shaping and drive circuit (B) 42, whereby hours hand 18 and minutes hand 17 are rapidly rotated to positions which indicate the hours and minutes of current time. The current time and alarm time position calculation circuit (B) 56 also determines at this time the appropriate direction of rotation of electromechanical transducer (B) 44 for returning minutes hand 16 and hours hand 18 to the current time indicating positions as rapidly as possible, and applies a signal designating this direction of rotation over line 68 to waveform shaping and drive circuit (B) 42.

If crown 22 is pulled to the second outward position, then a mechanical coupling is established between crown 22 and wheel train (B) 46, as indicated by line 48 in FIG. 2. At the same time, transfer of drive pulses to electromechanical transducers (A) 36 and (B) 44 is inhibited. The hands 14 to 18 are now stationary. The time indicated by minutes hand 16 and hours hand 18 can now be advanced or retarded, as required, by rotation of crown 22 in the counterclockwise or clockwise direction, respectively, so that a desired current time indication can be set. When crown 22 is now returned from the second outward position to the inward position, to re-enter the current time mode, a signal is generated by control circuit 50 which resets various counter circuits to a count of zero. The circuits thus reset include frequency divider circuit 28, seconds counter circuit 30, main counter circuit 34, and auxiliary counter circuit 54. One second after this overall zero reset has been performed, a first pulse is output by frequency divider circuit 28, which advances seconds hand 14 by one second. Thus, time setting can be performed in response to a standard broadcast time signal, for example, as in the case of a conventional analog display timepiece. In other words, shortly before such a time signal is to occur, at a time when seconds hand 14 has reached the zero position, crown 22 is pulled to the second outward position thereby fixing seconds hand 14 at the zero position. Crown 22 is then rotated to set minutes hand 16 and hours hand 18 to the desired time indication. When the broadcast time signal occurs, crown 22 is immediately returned to the inward position, and one second thereafter seconds hand 14 is advanced by one second from the zero position. Thereafter, the current time will be correctly indicated by analog display section 12.

Figure 3:
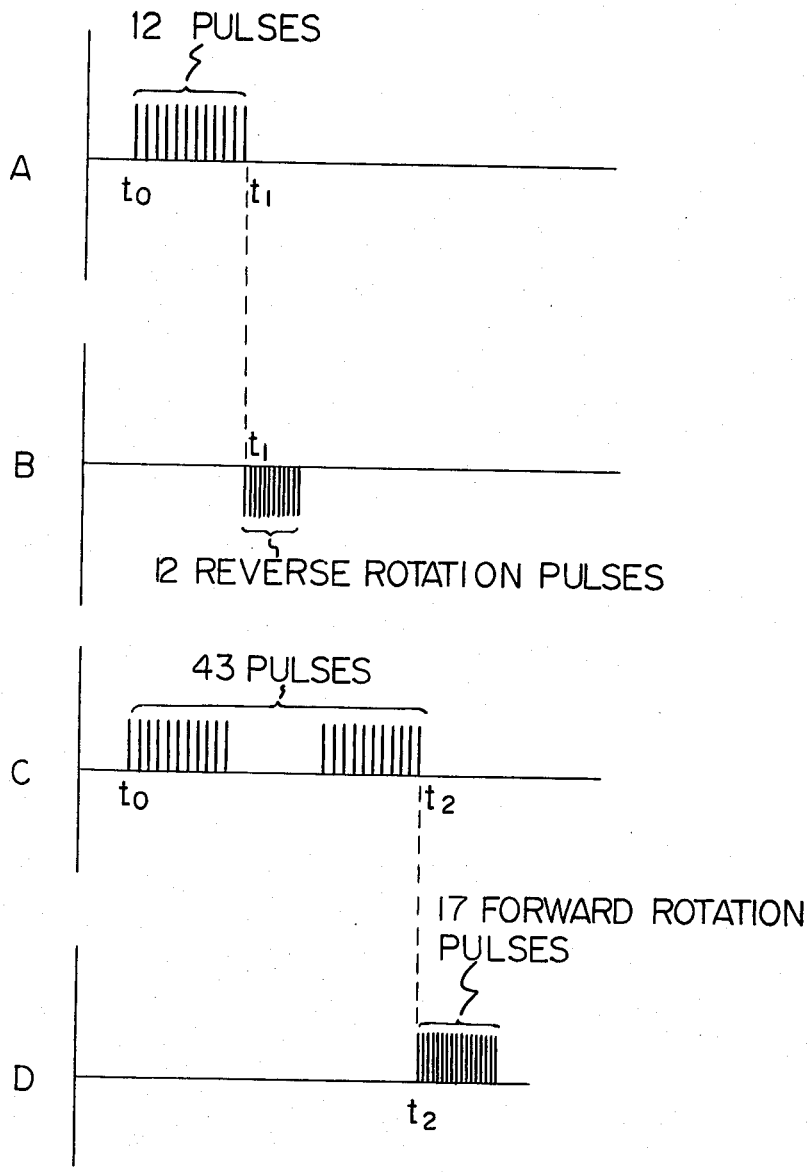
FIG. 3 and FIG. 4 are waveform diagrams for illustrating the operation of the embodiment of FIG. 2.
Figure 12:
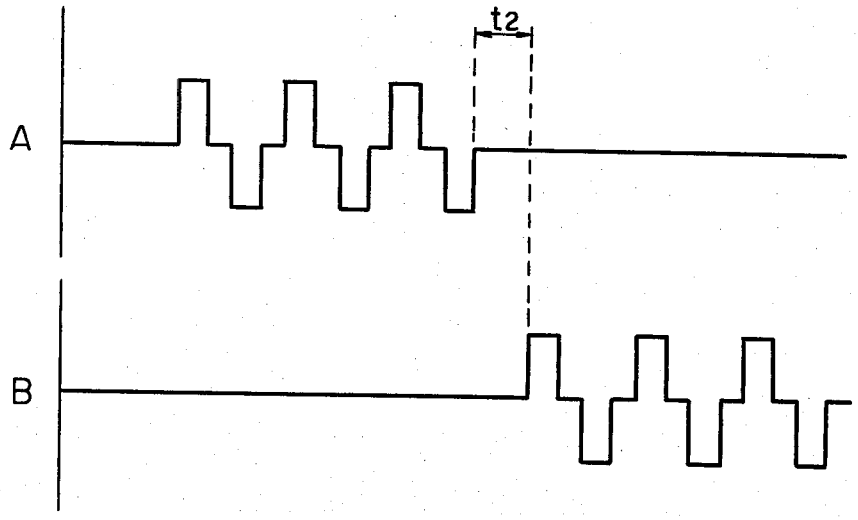
FIG. 12 is a waveform diagram for illustrating a method according to the present invention for rapidly driving the hands of an analog display electronic timepiece to predetermined positions by applying a group of drive pulses to a first transducer and then a group of pulses to a second transducer.
Figure 17:
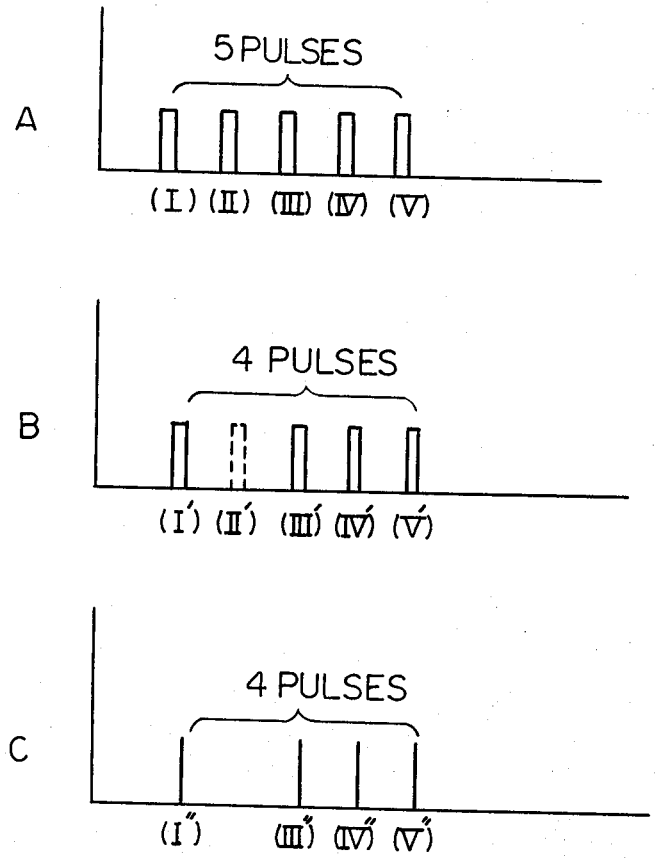

The operation of zero position calculation circuit 33 will now be described in more detail, with reference to the timing diagrams of FIG. 3. FIG. 3A illustrates the case in which 12 pulses have been counted by seconds counter circuit 30, from a time $t_0$ when seconds hand 14 is at the zero position and the count in seconds counter circuit 30 is zero, up to a time $t_1$ when crown 22 is pulled out to the first outward position so that the alarm mode is entered. As shown in FIG. 3B, 12 pulses are generated by seconds hand position calculation circuit 33 to cause reverse rotation of electromechanical transducer (A) 36 (referred to as reverse rotation pulses) to thereby rotate seconds hand 14 back by 12 seconds to the zero position. For the case shown in FIG. 3C, 43 pulses have been counted by seconds counter circuit 30 from time $t_0$ up to a time $t_2$ when a changeover is made from the current time mode to the alarm time mode. In this case, as shown in FIG. 3D, 17 pulses to cause forward rotation of seconds hand 14 are produced by seconds hand position calculation circuit 33, so that seconds hand 14 will be rotated in the clockwise direction to the zero position. In FIG. 3, pulses produced by seconds hand position calculation circuit which cause clockwise rotation of seconds hand 14 are drawn in the upward, i.e. positive direction, while pulses which cause rotation of seconds hand 14 are drawn in the downward, i.e. negative direction.

It can be understood from the above that, if the count in seconds counter circuit 30 is in the range of one second to 30 seconds when return to the zero position is to be performed, then output signals from zero position calculation circuit 33 cause seconds hand 14 to be rotated in the reverse direction to the zero position. Conversely, if the count in seconds counter circuit 30 is within the range 31 to 59 seconds, then signals from seconds hand position calculation circuit 33 cause seconds hand 14 to be rotated in the clockwise direction to the zero position. This ensures that seconds hand 14 is always returned to the zero position as rapidly as possible.

Figure 4:
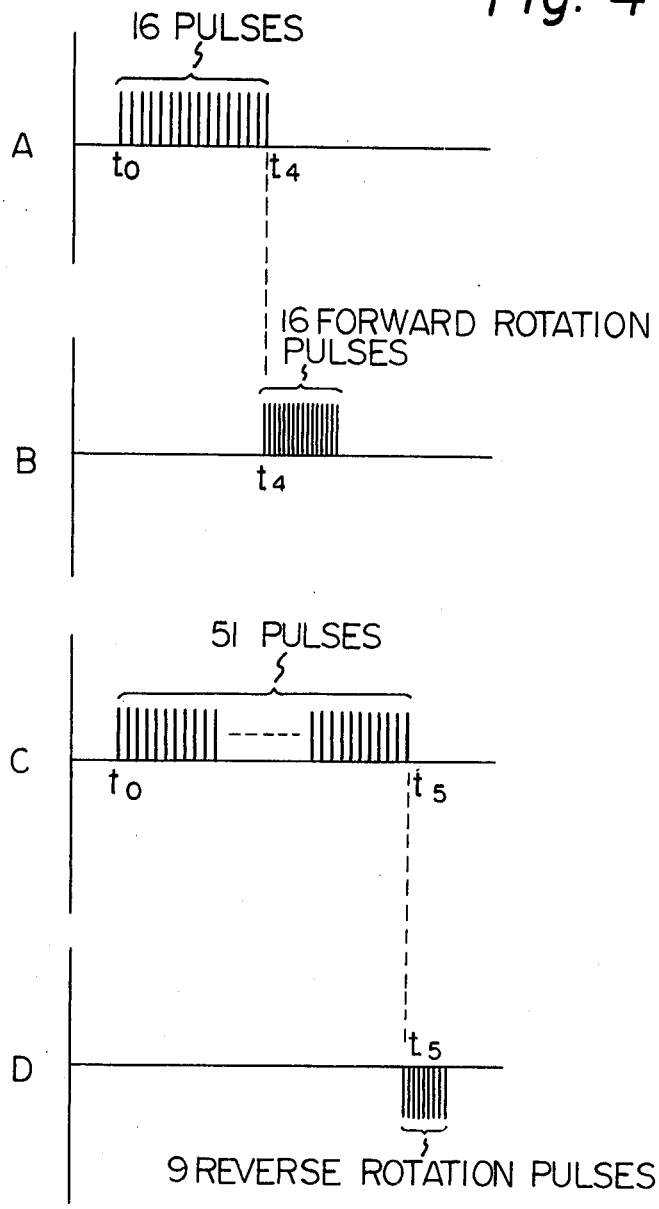
Figure 16:
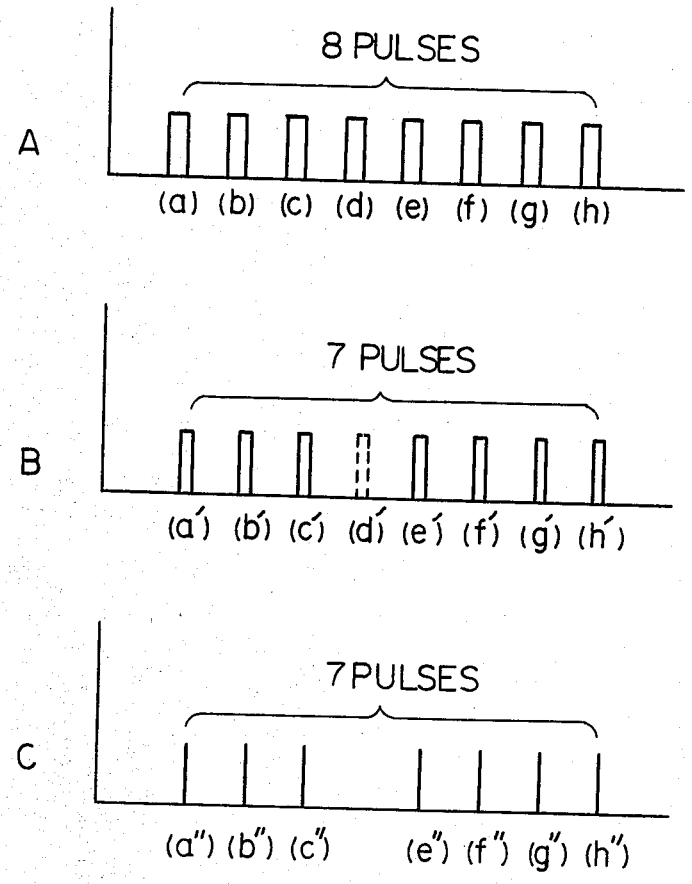
FIGS. 16 and 17 are waveform diagrams for illustrating the operation of the embodiment of FIG. 15.

FIG. 4 is a timing diagram to illustrate the operation of current time position calculation circuit (A) 31. At time $t_0$ as shown in FIG. 4A, seconds counter circuit 30 is at a count of zero, and seconds hand 14 is at the zero position. At time $t_4$, when 16 pulses have been counted by seconds counter circuit 30, a changeover is performed from the alarm time mode (in which seconds hand 14 is held at the zero position) to the current time mode. As shown in FIG. 4B, 16 forward rotation pulses are generated by current time position calculation circuit (A) 31, from $t_4$. Seconds hand 14 is rotated, clockwise in response, through an analog equivalent to 16 seconds from the zero position, to thereby indicate the correct value of current time seconds information. For the case shown in FIG. 3C, seconds counter circuit 30 has counted 51 pulses, from the zero position up to a time $t_5$, with the timepiece in the alarm time mode. At $t_5$, a changeover is made to the current time mode. In response, as shown in FIG. 3D, current time position calculation circuit (A) 31 generates 9 reverse rotation pulses. Seconds hand 14 is thereby rotated in the counterclockwise direction through an angle representing 9 seconds, from the zero position, to thereby indicate the correct value of current time seconds information, i.e. 51 seconds.

Thus, as for the seconds hand position calculation circuit 33, current time position calculation circuit (A) 31 acts to produce a group of pulses which cause seconds hand 14 to be rapidly set to a desired position, but in this case the position corresponds to the current time seconds indication. If at the time of changeover from the alarm time to the current time mode, the count of seconds counter circuit 30 is in the range from one to 30 seconds, then forward rotation pulses are produced by current time position calculation circuit (A) 31 (i.e. a group of pulses is generated, and transferred to waveform shaping and drive circuit (A) 34 while in addition a signal is sent over line 66 to waveform shaping and drive circuit (A) 34 which designates that these pulses are to cause forward rotation of seconds hand 14), while if the count of seconds counter circuit 30 is in the range from 31 to 59 seconds, then reverse rotation pulses are produced by current time position calculation circuit (A) 31. Seconds hand 14 is thereby set to the current time position, as rapidly as possible.

Figure 5A:
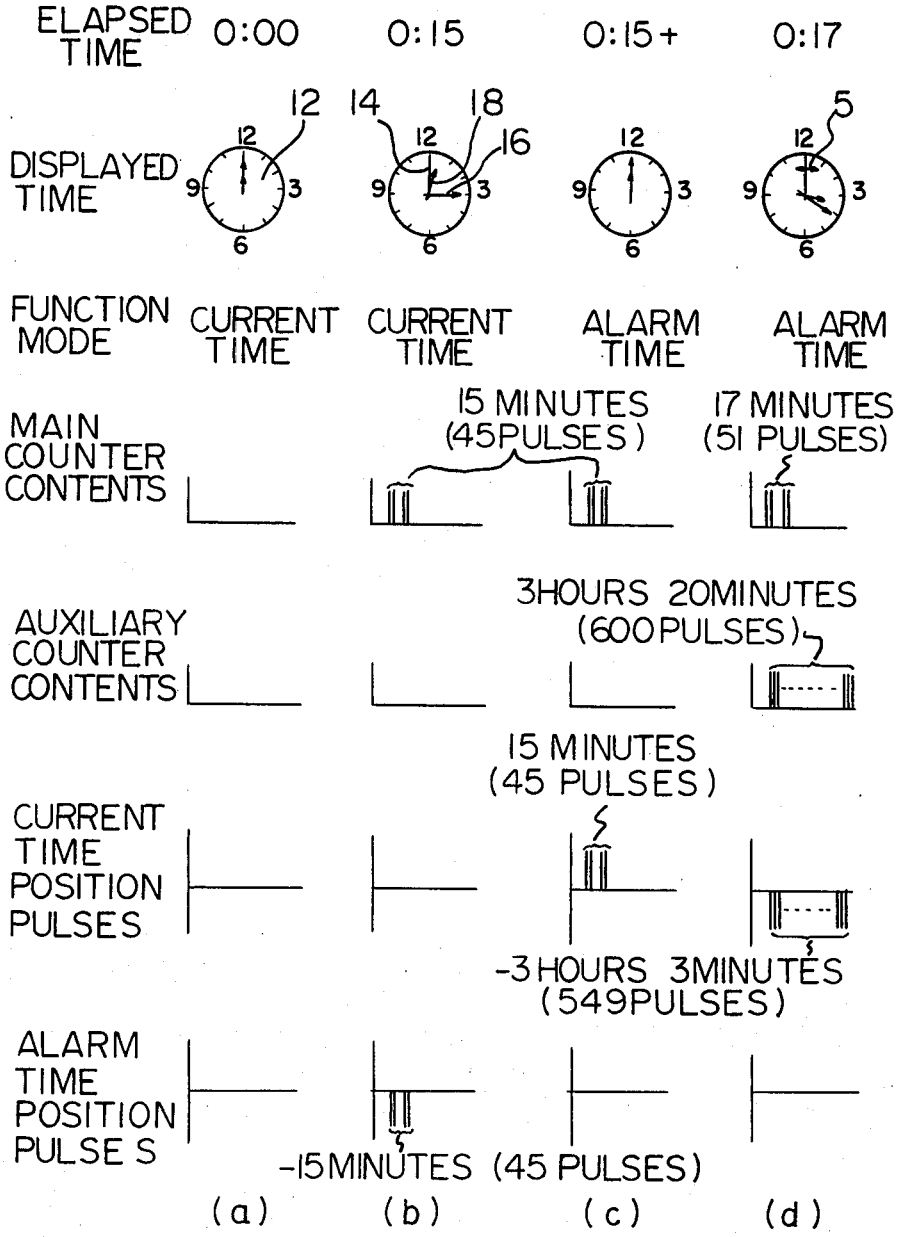
FIG. 5 is a diagram for illustrating a specific example of an alarm time being set into the embodiment of FIG. 2, and of changes in the contents of the main and auxiliary counter circuits as time elapses.
Figure 5B:
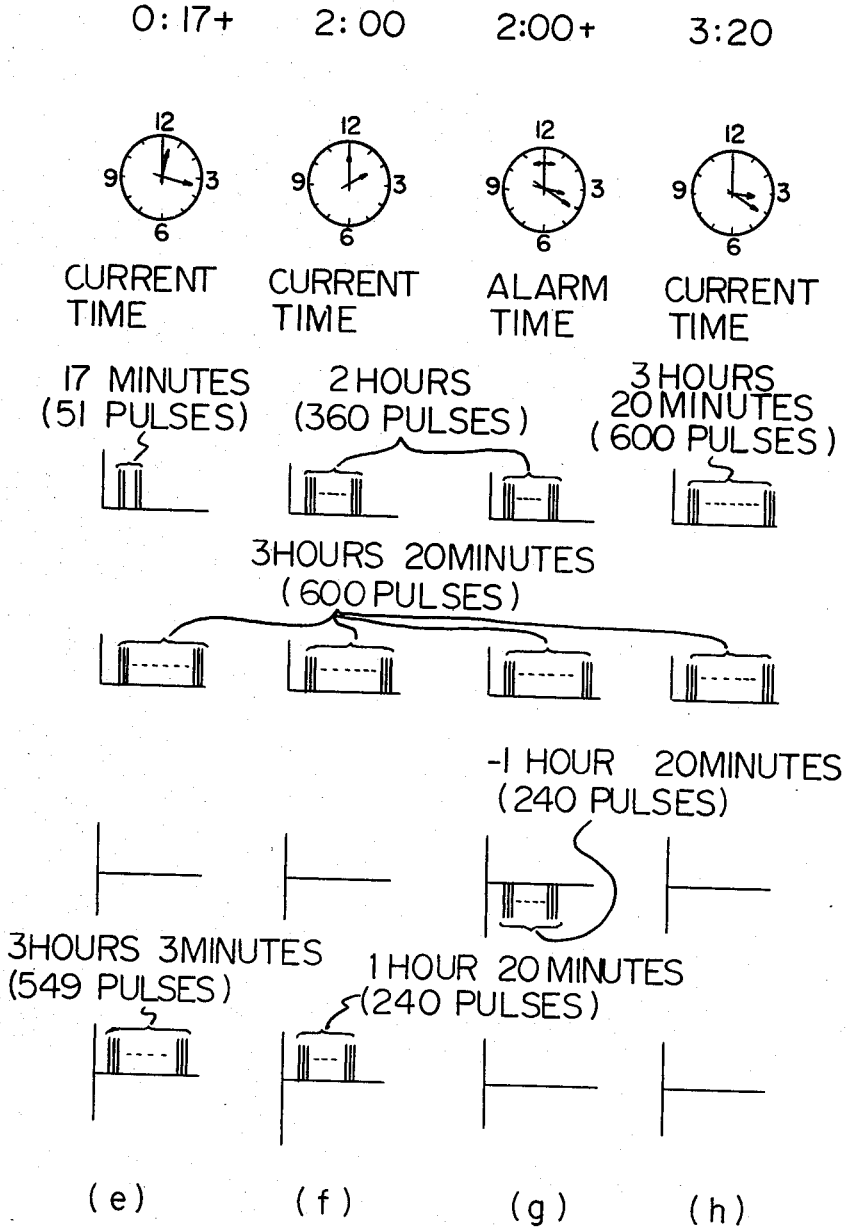

The operation of current time and alarm time position calculation circuit (B) 56 will now be described, with reference to FIG. 5. FIG. 5 shows a specific example of setting a current time indication and setting in an alarm time. The first, i.e. topmost line of FIG. 5 shows successive values of elapsed time, at which successive conditions occur after an initial reset operation has been performed. The second line, "displayed time," shows the indication provided by analog display section 12. The third line indicates the function mode. The fourth line indicates the contents of main counter circuit 34, as a pulse count and as the equivalent time value. It should be noted that, since three pulses are output by seconds counter circuit 30 per minutes, the number of pulses counted is three times the equivalent time value in minutes. The fifth line indicates the contents of auxiliary counter circuit 54. The sixth line shows the number of pulses which would be generated by current time and alarm time position calculation circuit (B) 56 at each time point, if a changeover were to be made from the alarm time to the current time mode at that point. The seventh line, designated "alarm time position pulses" shows the number of pulses which would be generated by current time and alarm time position calculation circuit (B) 56 at each time point, if changeover were to be performed from the current time mode to the alarm mode at that point.

At the initial time point, corresponding to the column designated as FIG. 5(*a*), crown 22 has just been pushed to the inward position, from the second outward position, with the hands 14, 16 and 18 having been set to indicate a time of 0 hours 00 minutes (0:00). In other words, the current time indicated by analog display 12 has just been set, for example in response to a broadcast time signal at exactly 12 o-clock (A.M. or P.M.). As described hereinabove, pushing crown 22 from the second outward position to the inward position causes switch mechanism 23 to activate control circuit 50 to generate an overall reset signal, which resets the contents of frequency divider circuit 28, seconds counter circuit 30, main counter circuit 34, and auxiliary counter circuit 54, to a count of zero. FIG. 5(*b*) shows the condition after 15 minutes have elapsed from the zero reset point. 45 pulses, corresponding to 15 minutes, have been counted by main counter circuit 34. At this time, a transition from the current time to the alarm time mode is performed, by pulling crown 22 out to the first outward position. 45 reverse rotation pulses, corresponding to −15 minutes (i.e. rotation of minutes hand 16 and hours hand 18 in the counterclockwise direction by an amount equivalent to 15 minutes) are generated by current time and alarm time position calculation circuit (B) 56. At the same time, seconds hand 14 is returned to the zero position, as described hereinabove. The resultant condition is established very rapidly, and is indicated in FIG. 5(*c*), which indicates a point in time very shortly after time 0:15 in FIG. 5(*b*). All of the hands are now at the zero position. If a changeover were to be made from the alarm time to the current time mode at the time shown in FIG. 5(*c*), then as shown in the line "current time position pulses" a total of 45 forward rotation pulses would be generated by current time and alarm time position calculation circuit (B) 56. However the timepiece is left in the alarm time mode, and an alarm time of 3 hours 20 minutes (3:20) is set in by rotation of crown 22. This alarm time setting is assumed to be completed by the current time point 0:17, as shown in FIG. 5(*d*).

The conditions at FIG. 5(*d*) are as follows. The alarm ON/OFF memory circuit 27 has been set to the ON state, so that seconds hand 14 is vibrating about the zero position, as shown. The main counter circuit 34 contains a count of 51 pulses, corresponding to 17 minutes. The auxiliary counter circuit 54 contains a count of 600, corresponding to the alarm time of 3:20 which has been set therein. If changeover from the alarm time to the current time mode were to be immediately performed, current time and alarm time position calculation circuit (B) 56 would produce 549 reverse rotation pulses, corresponding to rotation of minutes hand 16 and hours hand 18 in the counterclockwise direction by an amount equivalent to 3 hours 3 minutes (i.e. the difference between the indicated alarm time and the actual current time).

At time 0:17, such a changeover to the current time mode is performed, so that the pulses from current time and alarm time position calculation circuit (B) 56 cause the analog display section 12 to indicate the current time of 0:17. (For brevity of description, all of the operations in FIG. 5 are assumed to occur when seconds hand 14 is at the zero position. The control of seconds hand 14 during transitions between the current time mode and alarm time mode has been described hereinabove). The condition immediately after the current time mode is re-entered is shown in FIG. 5(*e*). The main counter circuit 34 contains a count of 51 pulses still, auxiliary counter circuit 54 contains a count of 600 pulses, and if a changeover back to the alarm time mode were to be immediately performed, then 549 forward rotation pulses, corresponding to a time advance of 3 hours 3 minutes would be generated by current time and alarm time position calculation circuit (B) 56.

The timepiece is now left in the current time mode until 2:00, i.e. 2 o-clock, as shown in FIG. 5(*f*). At this point, 360 pulses have been counted by main counter circuit 34, and auxiliary counter circuit 54 still contains a count of 600. The timepiece is now set into the alarm time mode, by pulling crown 22 to the first outward position, so that the present alarm time can be checked by the user. 240 forward rotation pulses, equivalent to a time advancement of one hours and 20 minutes, are therefore generated by current time and alarm time position calculation circuit (B) 56, in order to advance the time indicated by analog display section 12 by an amount equal to the difference between the preset alarm time and the current time. The resultant condition immediately thereafter is shown in FIG. 5(*g*). The preset alarm time of 3:20 is indicated, seconds hand 14 is vibrating about the zero position to indicate that the alarm is in the on state, the contents of auxiliary counter circuit 54 are unchanged, and the contents of main counter circuit 34 have not yet changed. If a changeover were to be immediately made to the current time mode, then 240 pulses, equivalent to a reverse rotation of hands 16 and 18 by a time of 1 hour and 20 minutes, would be generated by current time and alarm time position calculation circuit (B) 56.

Subsequently, the timepiece is returned to the current time mode, and remains in that mode until a current time of 3:20, as shown in FIG. 5(*h*). The main counter circuit 34 now contains a count of 600 pulses, equivalent to a time of 3 hours 20 minutes, i.e. the contents of main counter circuit 34 and auxiliary counter circuit 54 are now in coincidence. This is detected by coincidence detection circuit 58, causing a detection signal to be applied therefrom to alarm unit 60. Since alarm ON/-OFF memory circuit 27 is in the on state, alarm unit 60 is enabled to emit an audible alarm signal.

In the above example, main counter circuit 34 was set to a count of zero at a current time of 12 o-clock (which is of course equivalent to zero hours, for a 12 hour timekeeping cycle). However it should be noted that, although convenient, it is not necessary that the contents of main counter circuit 34 correspond with the current time indicated by analog display section 12. This marks an important difference between the present invention and prior art timepieces in which both an analog display and also a counter circuit for counting current time information are provided, and in which the contents of the latter counter circuit must always correspond to the current time indication of the analog display. With a timepiece according to the present invention, main counter circuit 34 can be reset to a count of zero at any arbitrary time, for example at a current time of 6:00. In this case, an alarm time can be set in as described above with respect to FIG. 5, but with the difference that the user must add six hours to the alarm time which is set, i.e. must add the difference between the current time and the time represented by the contents of main counter circuit 34. If can thus be seen that, while it is most convenient to reset the contents of main counter circuit 34 to zero at a current time of 12 o-clock, it is not essential, with a timepiece according to the present invention.

Figure 6:
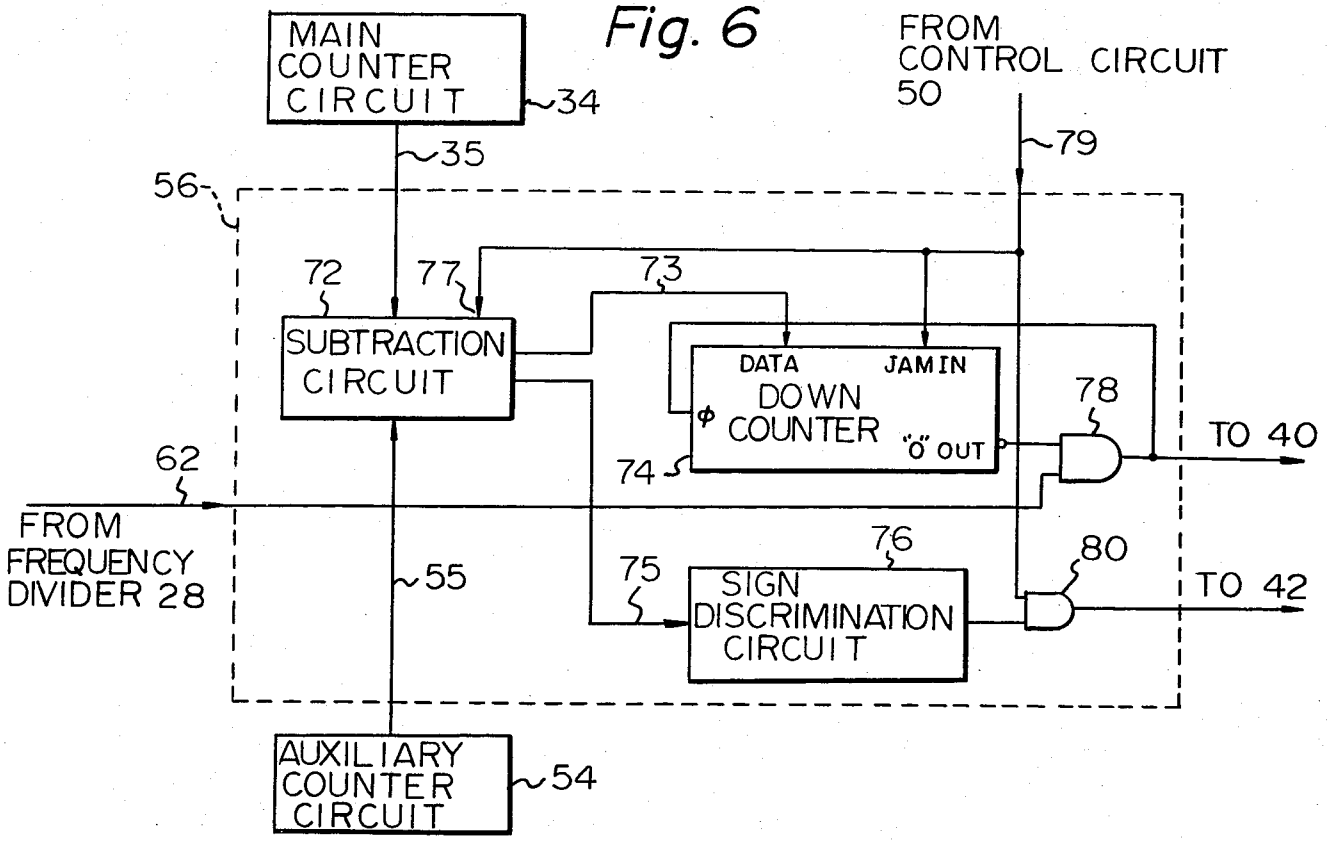
FIG. 6 is a circuit diagram of an embodiment of a current time and alarm time position calculation circuit used in the embodiment of FIG. 2.

Referring now to FIG. 6, a practical example of a circuit for current time and alarm time position calculation circuit (B) 56 will be described. Numeral 35 denotes a group of signal lines over which the contents of main counter circuit 34 are transferred as parallel binary signals, to inputs of a subtraction circuit 72. Numeral 55 denotes a set of signal lines over which the contents of auxiliary counter circuit 54 are transferred in parallel to another set of inputs of subtraction circuit 72. Output sigals which represent the difference between the contents of main counter circuit 34 and auxiliary counter circuit 54 are transferred over a set of lines denoted by numeral 73 to data input terminals, designated "DATA" of a down counter circuit 74. Down counter circuit 74 is of a well known type. When a high logic level signal (abbreviated hereinafter to H level) is applied to terminal designated JAM IN, then the binary numeric value represented by signals applied to the DATA input terminals is written into an internal counter circuit. While the contents of this internal counter circuit are other than zero, the terminal "0" OUT remains at the low logic level potential (abbreviated hereinafter to L level). In this condition, clock pulses applied to a clock input terminal $\phi$ serve to count down the contents of the internal counter circuit toward zero. When a count of zero is reached, then the "0" terminal goes to the H level. In this embodiment, the output signal from the "0" OUT terminal is inverted, so that an H level signal is produced therefrom when the internal counter contents are other than zero, and an L level output is produced when the internal counter contents reach zero. A signal discrimination circuit 76 determines whether the contents of main counter circuit 34 or auxiliary counter circuit 54 are greater, in accordance with data sent over a line 75 from subtraction circuit 72, and produces an H level or L level output signal in accordance with this determination. This discrimination signal is applied to one input of an AND gate 80, while a signal from control circuit 50, applied over a line 79, is applied to the other input of AND gate 80. This signal from control circuit 50 is also applied to the JAM IN terminal of down counter circuit 74 and to an input of subtraction circuit 72, i.e. terminal 77.

The operation of this circuit is as follows. Whenever a transition is made from the alarm time mode to the current time mode, or vice versa, the signal from control circuit 50 over line 79 goes to the H level, thereby enabling subtraction circuit 72 to operate and to transfer signals representing the difference between the contents of main counter circuit 34 and auxiliary counter circuit 54 to the DATA input terminals of down counter circuit 74. At the same time, this signal from control circuit 50, applied to the JAM IN input of down counter circuit causes the data sent from subtraction circuit 72 to be written into the internal counter of down counter circuit 74. The inverted "0" OUT signal therefore goes to the H level, so that AND gate 78 is enabled to pass a train of clock pulses sent from frequency divider circuit 28 over line 62, to the $\phi$ clock input of down counter circuit 74 and also to changeover control circuit 40, and from there to waveform shaping and drive circuit (B) 42. At the same time, the signal applied from control circuit 50 over line 79 enables AND gate 80, so that a sign discrimination signal produced by sign discrimination circuit 76 is transferred to waveform shaping and drive circuit (B) 42, designate that the pulses sent from AND gate 78 are to act as either forward rotation or reverse rotation pulses, i.e. to cause rotation of minutes hand 16 and hours hand 18 in the clockwise or the counterclockwise direction. The time indicated by analog display section 12 therefrom begins to move in the appropriate direction toward either the current time indication or alarm time indication, as described above with the example of FIG. 5.

When a number of pulses equal to the difference between the contents of main counter circuit 34 and auxiliary counter circuit 54 has been counted down by down counter circuit and transferred to waveform shaping and drive circuit (B) 42, i.e. when the contents of down counter circuit reach zero, then the inverted "0" OUT terminal goes to the L logic level, so that AND gate 78 is inhibited. Further transfer of clock pulses through AND gate 78 is thereby interrupted, and minutes hand 16 and hours hand 18 are now halted at the appropriate time indication, i.e. the alarm time if changeover from the current time to the alarm time mode was performed, or the current time, if changeover from the alarm time mode to the current time mode was performed.

In the alarm time mode, subtraction circuit 72 subtracts the contents of auxiliary counter circuit 54 from those of main counter circuit 34, and transfers the result over data lines 73 to down counter circuit 74. In the current time mode, the contents of main counter circuit 34 are subtracted from those of auxiliary counter circuit 54, and the result transferred over lines 73 to down counter circuit 74.

Since the frequency of the clock pulses supplied from frequency divider circuit 28 over line 57 can be considerably higher than 1 Hz, it can be understood that the minutes hand 16 and hours hand 18 may be very rapidly rotated into the new indication positions, each time changeover between the current time and alarm time modes is performed.

Figures 7, 7A, 7B:
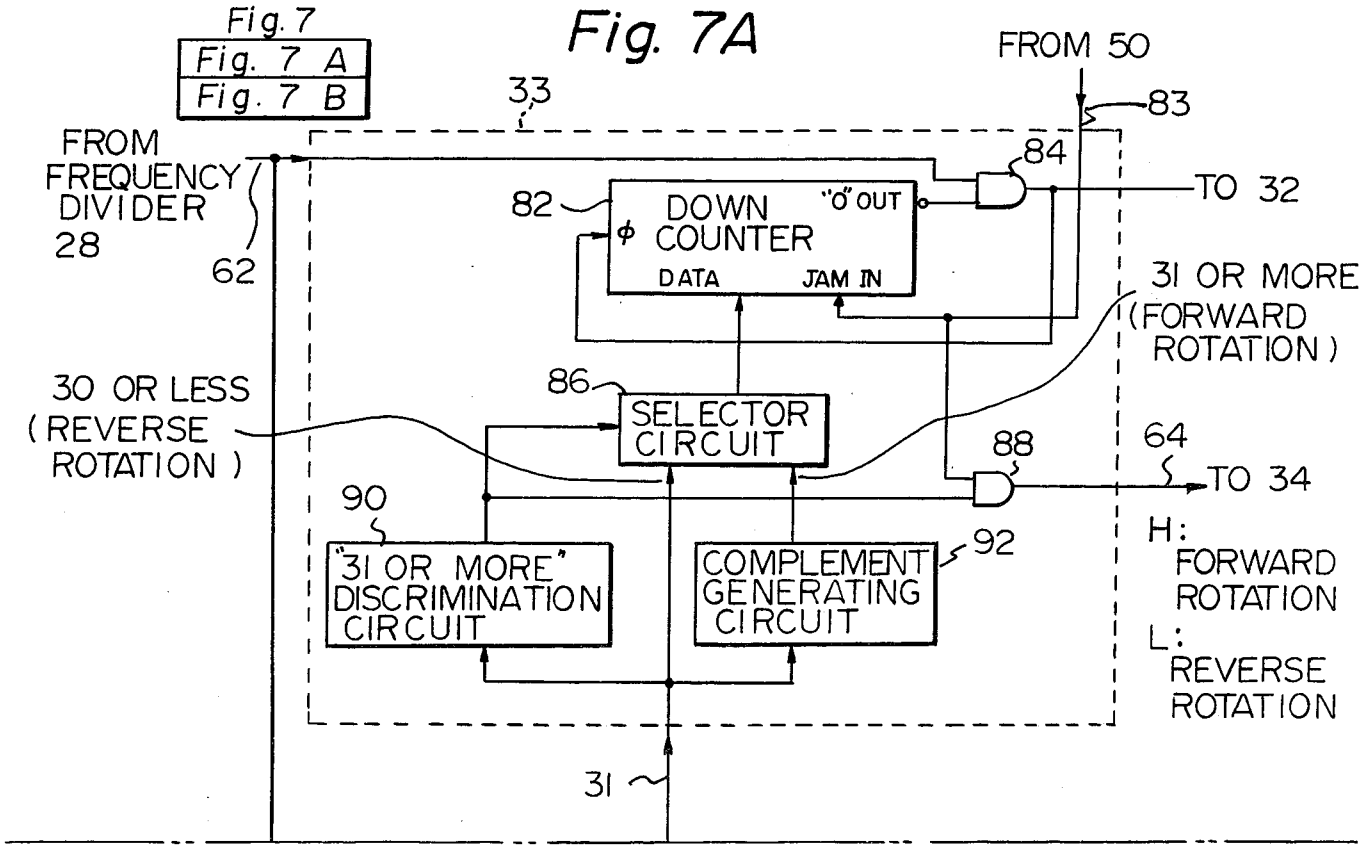
FIG. 7 is a circuit diagram of an embodiment of a zero position calculation circuit used in the embodiment of FIG. 2.
Figure 7B:
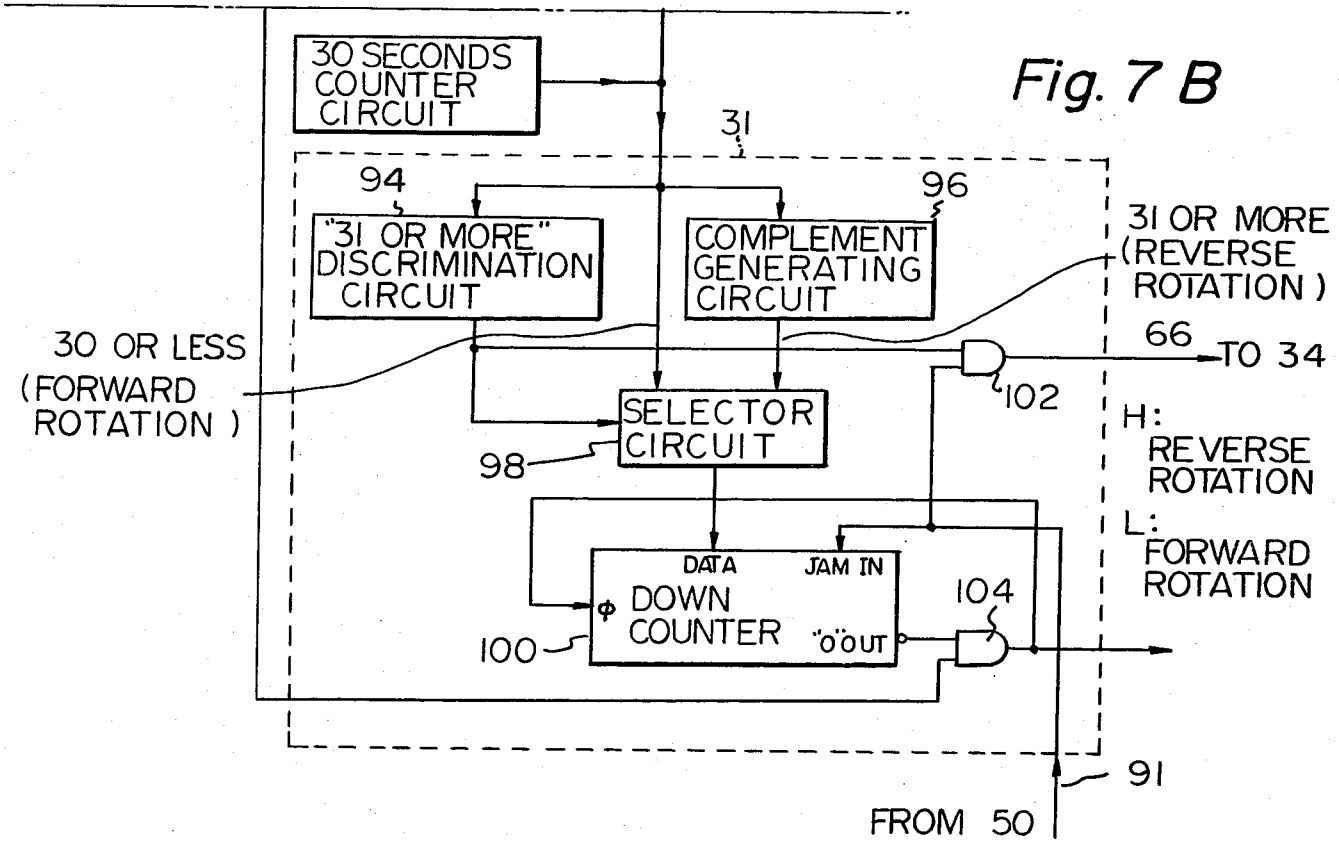

Referring now to FIG. 7, circuit diagrams are shown therein of specific examples of seconds hand position calculation circuit 33 and current time position calculation circuit (B) 31, each shown enclosed within a broken line rectangle. The seconds hand position calculation circuit 33 will first be described. Numeral 62 denotes the signal line over which a clock pulse signal train is transferred from frequency divider circuit 28. A signal from control circuit 50 is applied over a line 83, and goes from the L level to the H level when the timepiece is changed over from the current time mode to the alarm time mode. Numeral 82 denotes a down counter circuit which is identical to that described above with reference to the example of current time and alarm time position calculation circuit (B) 56 in FIG. 6, i.e., down counter circuit 74 therein. Output signals indicating the contents of seconds counter circuit 30 are transferred in parallel over a set of signal lines denoted by numeral 31, and are input to a "31 or more" discrimination circuit 90, to a selector circuit 86, and to a complement generating circuit 92. An output signal from "31 or more" discrimination circuit 90 goes to the H level if the contents of seconds counter circuit 30 are in the range from 31 to 59 seconds, and goes to the L level if the contents are in the range from one to 30 seconds. This output signal from "31 or more" discrimination circuit controls selector circuit 86 and also an AND gate 88. The complement generating circuit generates signals representing the complement of the contents of seconds counter circuit 30, and these are applied to a set of inputs of selector circuit 86. Output terminals of selector circuit 86 are coupled to the DATA input terminals of down counter circuit 82. The control signal on line 83 from control circuit 50 is applied to the JAM IN terminal of down counter circuit 82 and to an input of AND gate 88. Clock pulses applied over line 62 are applied to an input of an AND gate 84, while the inverted "0" OUT signal from down counter circuit 82 is applied to the other input of AND gate 84. The output of AND gate 84 is coupled to the $\phi$ clock input of down counter circuit 82 and also to an input of changeover control circuit (A) 32. The operation of zero position calculation circuit 33 of FIG. 7 is as follows. Normally, the inverted "0" OUT signal from down counter circuit 82 is at the L level so that AND gate 84 is inhibited. When a changeover from the current time mode into the alarm time mode is performed, line 83 from control circuit 50 goes to the H level, so that AND gate 88 is enabled and the output data from selector circuit 86 is written into the internal counter of down counter circuit 82. At this time, if the contents of seconds counter circuit 30 are in the range from 31 to 59, then the output signal from "31 or more" discrimination circuit 90 causes selector circuit 86 to select the complement of the contents of seconds counter circuit 30, produced by complement generating circuit 92, to be written into down counter circuit 82. At the same time, the output signal on line 64 from AND gate 88 goes to the H level, causing waveform shaping and drive circuit (A) 34 to be set in the condition for producing forward rotation pulses. The inverted "0" OUT signal is now at the H level, enabling AND gate 84, so that clock pulses are transferred to the clock terminal $\phi$ of down counter circuit 82 and to waveform shaping and drive circuit (A) 34. Forward rotation drive pulses are thereby generated, and produced until the contents of down counter circuit 82 reach zero, when AND gate 84 is once more inhibited. At this time, seconds hand 14 will have been driven forward to reach the zero position, as in the example of FIGS. 3C and 3D above.

If on the other hand the contents of seconds counter circuit 30 are in the range from 1 to 30 when changeover to the alarm time mode is performed, then the output signal from "31 or more" discrimination circuit 90 will be at the L level, so that AND gate 88 is inhibited, and an L level signal is applied over line 64 to waveform shaping and drive circuit (A) 34. Generation of reverse rotation drive pulses is thereby designated. At the same time, the contents of seconds counter circuit 30 are transferred directly by selector circuit 86, in response to the L level signal from "31 or more" discrimination circuit 90, to the DATA inputs of down counter circuit 82. Thereafter, a number of pulses equal to the contents of seconds counter circuit 30 are transferred by AND gate 84 to waveform shaping and drive circuit (A) 34, so that seconds hand 14 is rotated in the counterclockwise direction by an angle equivalent to the contents of seconds counter circuit 30. This is the process described above with reference to FIGS. 3A and 3B.

The example of current time position calculation circuit 31 shown in FIG. 7 will now be described. This is identical to the seconds hand position calculation circuit, comprising a "31 or more" discrimination circuit 94, a complement generating circuit 96, a selector circuit 98, down counter circuit 100, and AND gates 102 and 104. When a changeover is performed from the current time mode into the alarm time mode, then a signal applied over a line 91 from control circuit 50 goes from the L to the H level. As a result, if the contents of seconds counter circuit 30 are in the range from 31 to 59, then an output signal from "31 or more" discrimination circuit 94 goes to the H level, thereby enabling AND gate 102 and causing selector circuit 98 to transfer the complement of the contents of seconds counter circuit 30 from complement generating circuit 96 to the DATA inputs of down counter circuit 100. An H level output is now being applied over line 66 to waveform shaping and drive circuit (A) 34 which, in this case, designates that reverse rotation drive pulses are to be produced therefrom. A number of pulses equal to the complement of the contents of seconds counter circuit 30 is then transferred by AND gate 104, through changeover control circuit (A) 32 to waveform shaping and drive circuit (A) 34, so that seconds hand 14 is driven in the counterclockwise direction to the correct current time position. This is as described above with reference to the example of FIGS. 4C and 4D.

If the contents of seconds counter circuit 30 are in the range from 1 to 30, then they are transferred directly by selector circuit 98 to the DATA inputs of down counter circuit 100, due to the output signal from "31 or more" discrimination circuit down being at the L level. The output from AND gate 102, sent over line 34 to waveform shaping and drive circuit (A) 34 is now also at the L level, thereby designating output of forward rotation drive pulses therefrom. Thus, as a number of pulses equal to the contents of seconds counter circuit 30 are now transferred by AND gate 104 through changeover control circuit (A) 32 to waveform shaping and drive circuit (A) 34, seconds hand 14 is driven forward to reach the correct current time position. This process is as described above with reference to the example in FIGS. 4A and 4B.

In the above description, the term "complement" refers to a complement with respect to 60.

Figure 8:
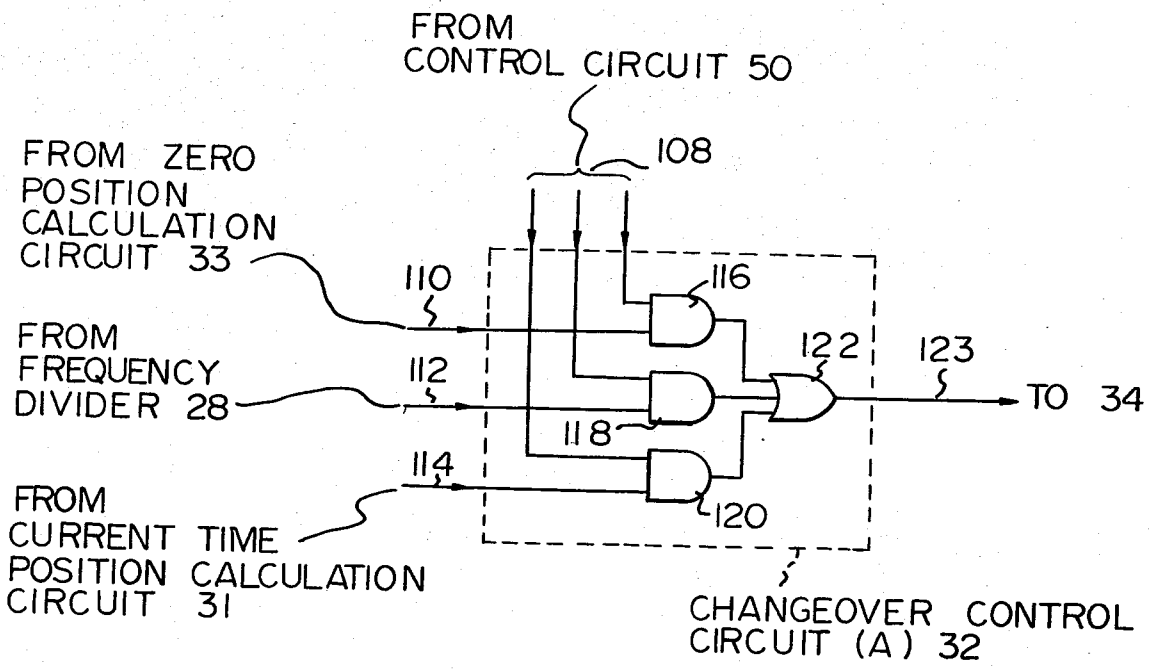
FIGS. 8 and 9 are circuit diagrams of embodiments of control changeover circuits used in the embodiment of FIG. 2.

Referring now to FIG. 8, an example of a circuit for changeover control circuit (A) 32 will be described. This comprises a set of three AND gates 116, 118 and 120, with the outputs from these AND gates being applied to inputs of an OR gate 122. A control signal is applied to each of these AND gates 116 to 120 over one of a set of 3 control lines, denoted by numeral 108, from control circuit 50. Output signals from zero position calculation circuit 33 are input over a line 110 to AND gate 116. Output signals from frequency divider circuit 28 are input over a line 112 to AND gate 118. Output signals from current time position calculation circuit (B) 31 are applied over signal line 114 to an input of AND gate 120. It will be apparent that when one of the control signal lines 108 goes to the H level while the other two control signal lines are at the L level, then the AND gate to which this H level control signal is applied will transfer the signals appearing on the corresponding one of signal lines 110, 112 or 114 through OR gate 122 to output line 123. The output signal thus selected is transferred to waveform shaping and drive circuit (A) 34.

Figure 9:
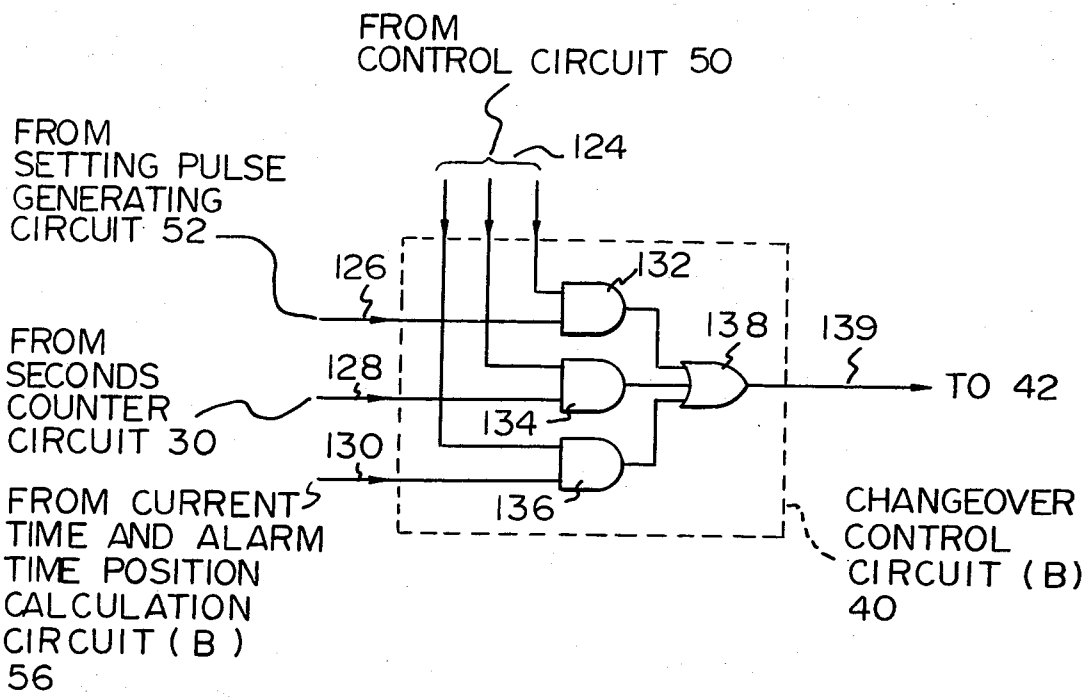

FIG. 9 is a circuit diagram of an example of changeover control circuit (B) 40, which is basically identical to that of FIG. 8. This comprises AND gates 132, 134 and 136, and an OR gate 138. Output signals from setting pulse generating circuit 52 are applied over a signal line 126 to an input of AND gate 132. Output signals from seconds counter circuit 30 are applied over a line 128 to an input of AND gate 124. Output signals from current time and alarm time position calculation circuit (B) 56 are applied over a line 130 to an input of AND gate 136. Selection of signals applied over lines 124, 128 or 130 is performed by control signals applied over three lines denoted by numeral 124, from control circuit 50. Selection is performed as explained for the circuit of FIG. 8, to thereby transfer selected signals over output line 139 to waveform shaping and drive circuit (B) 42.

Figure 10:
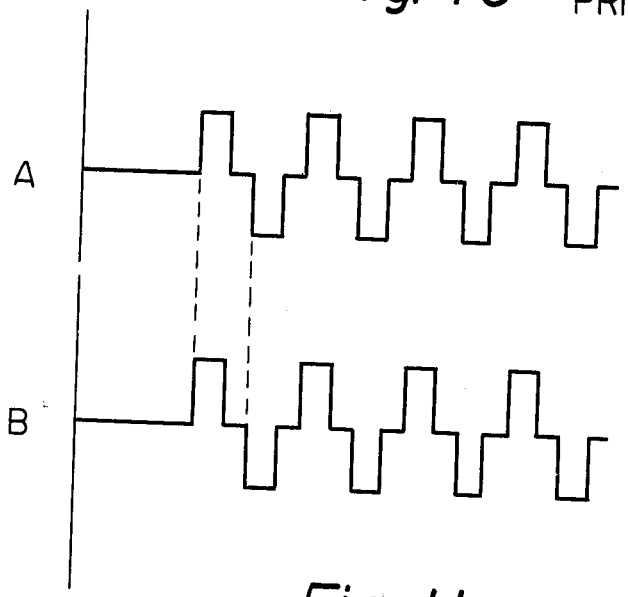
Fig. 10 PRIOR ART
FIG. 10 is a waveform diagram for illustrating a prior art method of rapidly driving the hands of an analog display electronic timepiece to predetermined positions by drive pulses applied simultaneously to a plurality of electromechanical transducers.

In the first embodiment described hereinabove, the seconds hand 14, minutes hand 16 and hours hand 18 are rapidly driven to predetermined new positions each time changeover is performed between the current time mode and the alarm time mode. As described, these changes in the positions of the hands are performed in response to groups of pulses produced by current time position calculation circuit (A) 31, seconds hand position calculation circuit 33, and current time and alarm time position calculation circuit (B) 56. These pulses, which will be referred to in the following description as "rapid advancement pulses," are transferred to the waveform shaping and drive circuits 34 and 42, to thereby drive electromechanical transducers 38 and 46 respectively. In the first embodiment, these rapid advancement pulses begin to be generated immediately after changeover between the current time and alarm time modes is performed, and the rapid advancement pulses from zero position calculation circuit 33 (or from current time position calculation circuit (A) 31) will be in synchronism with the rapid advancement pulses from current time and alarm time position calculation circuit (B) 56, since both sets of pulses are produced utilizing a clock pulse signal train from frequency divider circuit 28 sent over line 62 shown in FIG. 2. Thus, the relationship between the drive pulses produced in this case is shown in FIG. 10, in which FIG. 10A illustrates the drive pulses produced to drive the electromechanical transducer which rotates the seconds hand 14, comprising alternate positive and negative pulses, while FIG. 10B shows the drive pulses produced to drive the electromechanical transducer which rotates the hours and minutes hands. Thus, when rapid advancement pulses are being generated, both of the electromechanical transducers, for the seconds hand and for the hours and minutes hands, are driven in synchronism. Such a method is generally adopted in prior art analog timepieces having two or more independent electromechanical transducers, and has the disadvantage that the peak current drawn from the battery, while rapid advancement pulses are being generated, is excessively high. Thus, it may be necessary to use a larger size of battery than would be required for a timepiece having only one electromechanical transducer, in order to provide sufficient current supply capacity for rapid advancement drive. Another disadvantage is that, since both of the electromechanical transducers are always driven simultaneously while rapid advancement is in progress, it is necessary to provide two sets of drive inverters to drive the electromechanical transducers, i.e. a total of 4 drive inverters, as compared with only 2 drive inverters in the case of a timepiece having a single electromechanical transducer. This is a disadvantage, since such drive inverters occupy a relatively considerable amount of space within the integrated circuit of an electronic timepiece, and effectively determine the minimum size of the integrated circuit, and hence of the timepiece.

Figure 11:
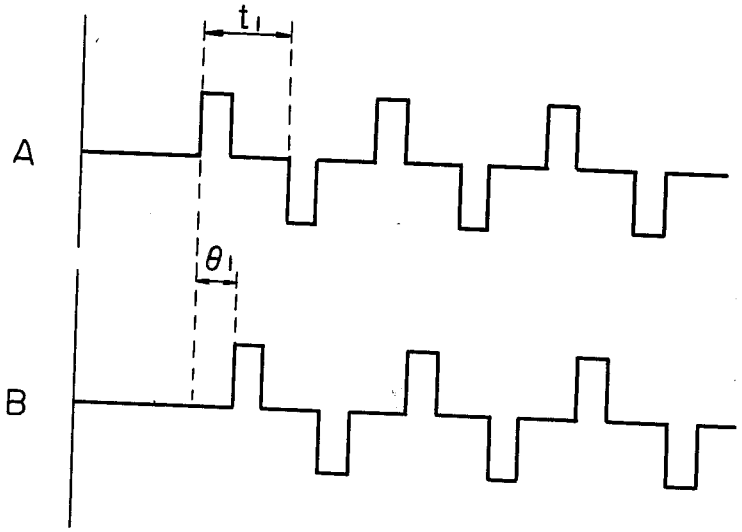
Fig. 11 PRIOR ART
FIG. 11 is a waveform diagram for illustrating a prior art method of rapidly driving the hands of an analog display electronic timepiece to predetermined positions, by two drive pulse trains applied to two electromechanical transducers, with a phase difference being provided between the pulse trains.

The above disadvantages can be overcome by providing a phase difference between the two sets of rapid advancement pulses used to drive the seconds hand and to drive the minutes and hours hands. This is illustrated in FIG. 11, in which FIG. 11A shows the drive signals used in advancing the seconds hand, when rapid advancement pulses are being generated, and FIG. 10A shows the drive signals used to rotate the minutes and hours hands. As shown, a phase difference $\theta 1$ is provided between the two sets of drive pulses of FIGS. 11A and 11B, i.e. a phase difference $\theta 1$ is provided between the two sets of rapid advancement pulses corresponding to these drive pulses. However, this has the disadvantage that the minimum value of the time difference $t_1$ between successive drive pulses, is increased. In other words, because of the phase difference provided between the two sets of rapid advancement pulses, the frequency of these pulses must be held below a certain value, so that the rate of rapid advancement of the hands is limited.

The above problems can be overcome by a system of generating rapid advancement pulses for an analog display electronic timepiece according to the present invention, described in the following. Generation of rapid advancement pulses with such a system is illustrated by the timing diagram of FIG. 12. FIG. 12A shows the drive pulses applied to one electromechanical transducer, i.e. that which advances the seconds hand, during rapid advancement. FIG. 12B shows the drive pulses applied to a second electromechanical transducer, i.e. that which advances the minutes and hours hands, during rapid advancement. As shown, FIG. 12A indicates a group of drive pulses generated to produce rapid rotation of the seconds hand, e.g. to rapidly return the seconds hand to the zero position, when a changeover from the current time to the alarm time mode is performed. After such a group of rapid advancement pulses has been completely generated, i.e. after the seconds hand has attained its new position, then another set of rapid advancement drive pulses is generated, as shown in FIG. 12B, to rotate the minutes and hours hands to their new positions, e.g. to indicate the preset alarm time. The latter pulses begin to be generated after a time interval $t_2$ following completion of the group of pulses (FIG. 12A) which have rotated the seconds hand. The latter time interval can be of any desired duration, or zero.

Such a rapid rotation of the seconds hand alone to a new position, e.g. the zero position, gives a clear indication to the user when a changeover from one mode to another is performed. In addition, since the two sets of rapid advancement drive pulses to drive the two electromechanical transducers are not generated simultaneously, the peak current drawn from the timepiece battery is no greater than when for a timepiece having only a single electromechanical transducer. Furthermore, it is possible to use one of the drive inverters which drive the electromechanical transducers in common, for two of the transducers, i.e. it is only necessary to use a total of three drive inverters.

Figure 13B:
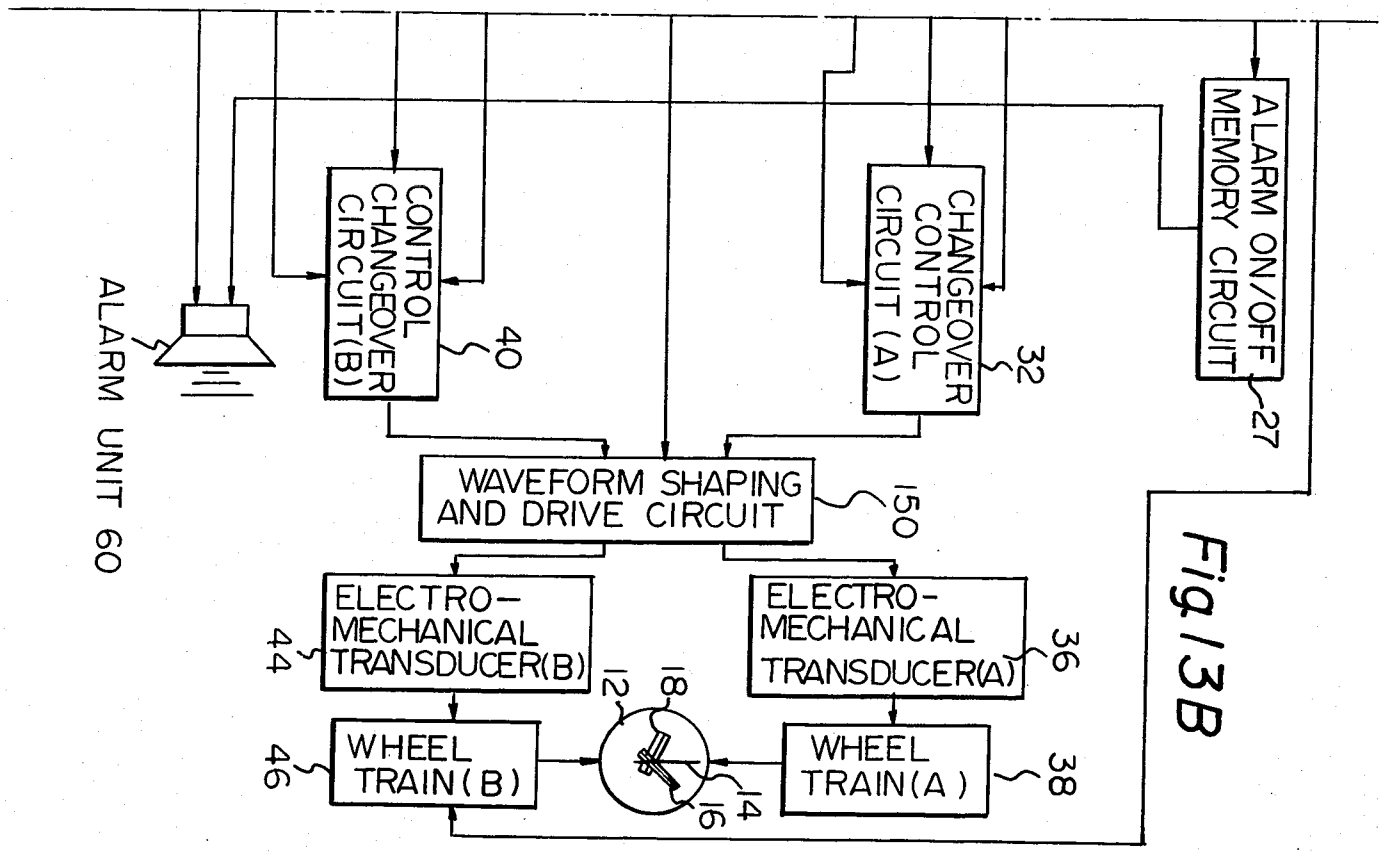
FIG. 13 is a block circuit diagram of a second embodiment of an analog display electronic timepiece according to the present invention, wherein the method of applying drive pulses to two electromechanical transducers illustrated in FIG. 12 is utilized.

FIG. 13 is a block circuit diagram of a second embodiment of an electronic analog display timepiece according to the present invention which employs the system of generating rapid advancement pulses described above. Various circuit blocks and components in this embodiment are identical in function to blocks or components in the first embodiment shown in FIG. 2, and therefore are indicated by identical reference numerals. Such blocks and components will not be further described. In addition, to simplify the drawing, waveform shaping and drive circuit (A) 34 and waveform shaping and drive circuit (B) 42 have been drawn as forming a single circuit block, denoted as waveform shaping and drive circuit 150. In addition, the various signal lines which control the direction of rotation of the electromechanical transducers have been omitted. The basic difference between the embodiment of FIG. 13 and that of FIG. 2 lies in the manner in which rapid advancement pulses are generated when changeover from one mode to another is performed. Instead of a single seconds hand position calculation circuit 33 as in the first embodiment, rapid advancement pulses are produced when a changeover is made from the current time to the alarm time mode by a combination of seconds hand position calculation circuit 141 and a rapid advancement pulse generating circuit 142. The latter circuit generates rapid advancement pulses in accordance with data supplied from seconds hand position calculation circuit 141, in response to a signal from control circuit 50. Numeral 140 denotes a remaining pulse detection circuit, which serves to detect when all of the rapid advancement pulses to be output by rapid advancement pulse generating circuit 142 have been output, and generates a control signal in response, which is input to a pulse output control circuit 149.

Similarly, rapid advancement pulses are produced when a changeover is made from the alarm time mode to the current time made by a combination of a current time position calculation circuit (A) 143 and a rapid advancement pulse generating circuit (A) 144, controlled by a signal from control circuit 50. When the requisite number of rapid advancement pulses have been output by rapid advancement pulse generating circuit (A) 144, this is detected by remaining pulse detection circuit 146, which responds by inputting a signal to pulse output control circuit 149.

When a changeover is made from the current time mode to the alarm time mode, or vice versa, then a rapid advancement pulse generating circuit 148 is activated by a signal from control circuit 50 to generate a number of rapid advancement pulses in accordance with data supplied by current time and alarm time position calculation circuit (B) 147. However, output of these rapid advancement pulses cannot begin until a control signal is supplied from pulse control circuit 149, which occurs when generation of pulses by either rapid advancement pulse generating circuit 142 or rapid advancement pulse generating circuit 144 has been completed, and a signal indicating such completion input to pulse output control circuit 149 from either remaining pulse detection circuit 140 or remaining pulse detection circuit 146. It will thus be apparent that the embodiment of FIG. 13 meets the requirements shown in the timing diagram of FIG. 12. The time delay $t_2$ between the end of rapid advancement pulses which act on the seconds hand 14 and the start of rapid advancement pulses which act on the minutes hand 16 and hours hand 18 can be easily provided by a suitable delay circuit in pulse output control circuit 149.

Thus, with the embodiment of FIG. 13, when a changeover is made from the current time mode to the alarm time mode, seconds hand 14 will rapidly rotate into the zero position, and remain there. Minutes hand 16 and hours hand 18 will then be rotated into positions indicating the preset alarm time, as for the first embodiment. This clearly indicates to the user that a changeover to the alarm time mode has been accomplished.

Figure 14B:
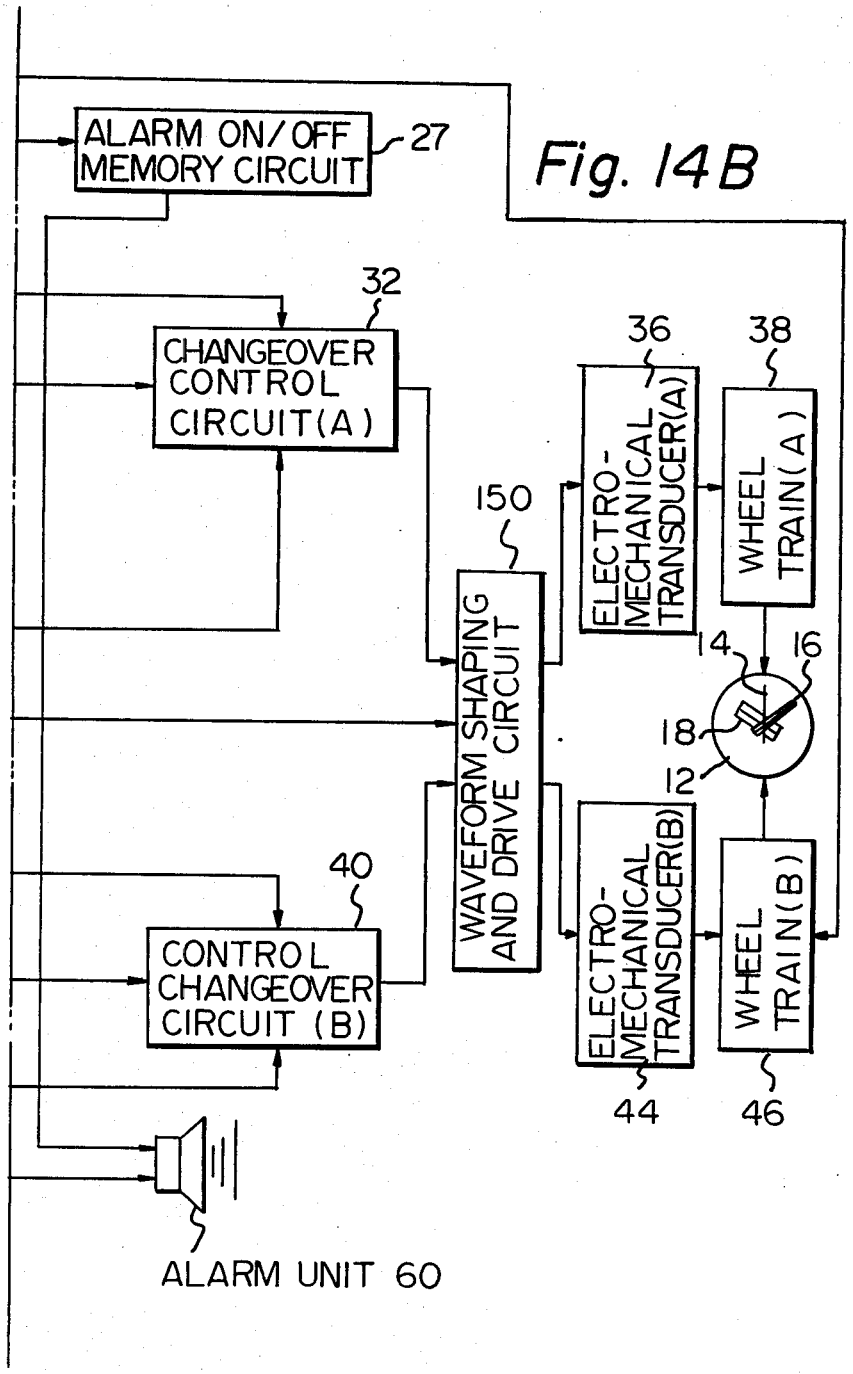
FIG. 14 is a block circuit diagram of a third embodiment of an analog display electronic timepiece according to the present invention, which is a modification of the embodiment of FIG. 13.

A third embodiment of an analog display timepiece according to the present invention is shown in FIG. 14. This serves to provide similar operation to that of the second embodiment described above, i.e. when changeover is made from one mode to another, the seconds hand 14 is first rapidly rotated to a new position, and then the minutes hand 16 and hours hand 18 are rotated to their new position. In the embodiment of FIG. 5, this is performed by means of a timer circuit 152, rather than by remaining pulse detection circuits and a pulse output control circuit. When changeover from the current time to the alarm time mode is performed, then an output signal from control circuit 50 causes rapid advancement pulses to be generated by rapid advancement pulse generating circuit 142, in accordance with data sent from seconds hand position calculation circuit 141. Seconds hand 14 is thereby rapidly rotated to the zero position. The latter signal from control circuit 50 also triggers operation of timer circuit 152, so that after a delay of, for example 0.5 second, an output signal is produced by timer circuit 152. This signal, applied as a control signal to rapid advancement pulse generating circuit 148, causes rapid advancement pulses to be output therefrom in accordance with data sent from current time and alarm time position calculation circuit (B) 56. As a result, rapid advancement drive pulses are applied from waveform shaping and drive circuit 150, whereby minutes hand 16 and hours hand 18 are driven by electromechanical transducer 44 through wheel train 46 to indicate the preset alarm time.

A similar process occurs when changeover from the alarm time to the current time mode is performed, but in this case rapid advancement pulses are first generated by rapid advancement pulse generating circuit 144, in accordance with data sent from current time position calculation circuit 143, whereby seconds hand 14 is rapidly set to the current time position.

In general, the electromechanical transducers utilized in an analog display timepiece according to the present invention will comprises ultra-miniature stepping motors. It is a characteristic of such a stepping motor that the rotor will occasionally fail to rotate correctly, i.e. to fully rotate, in response to a drive pulse applied to the motor coil. Such failure to operate correctly can occur due to pickup of external interference, or for various other reasons. Such mis-operation cannot occur with respect to incrementing of the main and auxiliary counter circuits, and this can cause the contents of these counter circuits to fail to correspond correctly with time indicated by the analog display section. Thus, for example if an alarm time of precisely 3 o-clock has been preset into the auxiliary counter circuit, and if the rotor of the stepping motor driving the hours and minutes hands fails to rotate correctly while the timepiece is in the current time mode so that the indicated current time is "slow" by one minute, then when the contents of the main counter circuit reach a value equivalent to 3 o-clock (3:00), the analog display section will be indicating a current time of 3:59. Such a discrepancy is undesirable, since an alarm signal will be generated at a time which is indicated as being inexact, by the analog display section.

In addition, in the embodiments described above, alarm time setting is performed by setting pulses being applied to drive the analog display section to indicate an alarm time, while these pulses are simultaneously counted by the auxiliary counter circuit. However, if the rotor of the stepping motor driving the hours and minutes hands should fail to operate correctly while such alarm time setting is being performed, in the alarm time mode, so that the set alarm time is slow by one minute, then if the user has set an alarm time indicated as 3 o-clock (3:00), the alarm time which is acutally set into the auxiliary counter circuit will be equivalent to 3:01. Thus, an alarm signal will be subsequently generated at a current time of 3:01, as indicated by the analog display section. This also makes the alarm time operation of the timepiece appear to be inexact, and is therefore an undesirable feature.

A fourth embodiment of an analog display timepiece according to the present invention will now be described whereby the problem described above is eliminated. This embodiment is shown in block diagram form in FIG. 15, and various blocks and components having identical functions to those of the previous embodiments are indicated by identical reference numerals. Such blocks and components will not be further described. The embodiment of FIG. 15 differs from the previous embodiments in that no seconds hand is provided, so that circuit sections relating to seconds hand driving are eliminated. Numerals 154 and 156 denote a timekeeping pulse control circuit and a alarm time pulse control circuit which control the input of pulses from frequency divider circuit 28 to main counter circuit 34 and from setting pulse generating circuit 52 to auxiliary counter circuit 54 respectively. The timekeeping pulse control circuit 154 and alarm time pulse control circuit 156 are controlled by signals generated by a transducer operation detection unit 158. These signals are generated by transducer operation detection unit 158 in accordance with whether the rotor of the stepping motor constituting electro-mechanical transducer 36 is fully rotated by a drive pulse applied from waveform shaping and drive circuit 42. If the timepiece is operating in the current time mode, then each time the rotor of stepping motor 36 is correctly rotated, a signal from transducer operation detection unit 158 enables timekeeping pulse control circuit 154 to transfer a pulse from frequency divider circuit 28 to be counted by main counter circuit 34. If the rotor has failed to be fully rotated, then transfer of the latter pulse to main counter circuit 34 is inhibited. The input of setting pulses to auxiliary counter circuit 54 is similarly controlled by signals from transducer operation detection unit 158 acting on alarm time pulse control circuit 156.

The embodiment of FIG. 15 will be further illustrated with reference to the timing diagram of FIG. 16, which illustrates operation in the alarm time mode. It will be assumed that the contents of auxiliary counter circuit 54 have been set to zero at a current time of exactly 12 o-clock. Crown 22 is then pulled out to the first position, establishing the alarm time mode, so that an alarm time can be set in. As shown in FIG. 16A, crown 22 is then rotated such that 8 pulses are generated by setting pulse generating circuit 52, designated as (a) to (h). These pulses are applied through waveform shaping and drive circuit 42 to drive stepping motor 36, however it is assumed that the rotor of stepping motor 36 fails to rotate in response to the fourth setting pulse (d). The resultant output signals from transducer operation detection unit 158 are as shown in FIG. 16B. These comprise 7 pulses (a′) to (h′) corresponding to the setting pulses of FIG. 16A, but with a pulse corresponding to setting pulse (d) being omitted, i.e. pulse (d′) is omitted. As a result of these pulses from transducer operation detection unit 158, alarm time pulse control circuit 156 produces the 7 pulses (a″) to (h″) shown in FIG. 16C, to be input to auxiliary counter circuit 54. Thus, the result of generating the 8 alarm time setting pulses of FIG. 16A will be that analog display section 12 indicates an alarm time of 12:07, and that a pulse count equivalent to a time of 12:07 is stored in auxiliary counter circuit 54. Thus, the contents of auxiliary counter circuit 54 and the time indicated by analog display section 12 are held in correspondence, in spite of an error in operation of stepping motor 36.

FIG. 17 illustrates the operation when the timepiece is in the current time mode. Here, 5 consecutive pulses (I) to (V) shown in FIG. 17A are output from frequency divider circuit 29, and applied through wavefrom shaping and drive circuit 42 to stepping motor 36. It will be assumed that the rotor of motor 36 fails to rotate correctly in response to the second of these pulses, (II), so that the output signal from transducer operation detection unit 158 is as shown in FIG. 17B, i.e. comprising 4 pulses with a pulse corresponding to pulse (II) omitted. As a result, only 4 pulses are produced by timekeeping pulse control circuit 154 as shown in FIG. 17C, to be counted by main counter circuit 34. Thus, the current time indication provided by analog display section 12 will be held in correspondence with the contents of main counter circuit 34, in spite of occasional failure of the rotor of stepping motor 36 to rotate correctly.

Figure 15A:
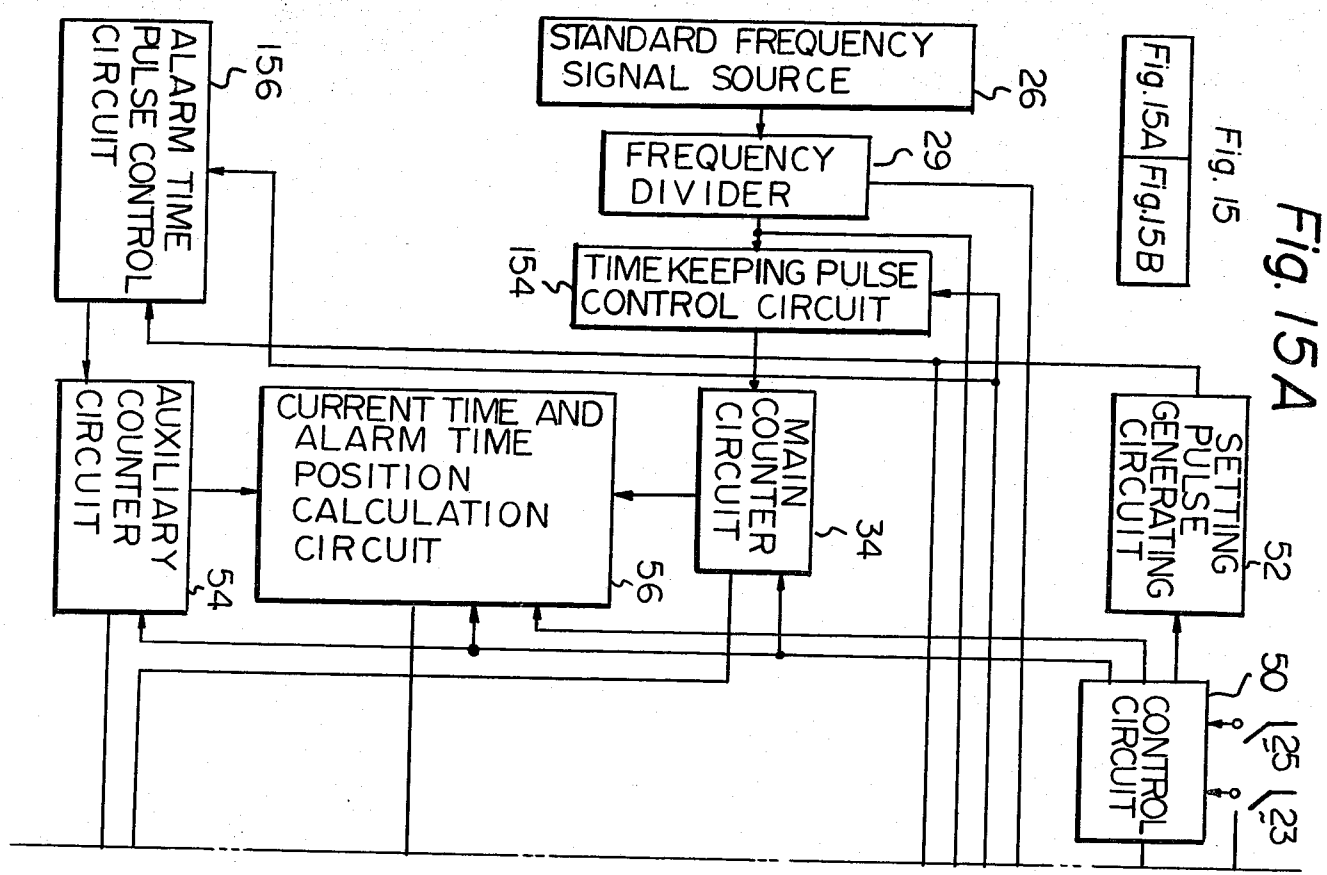
FIG. 15 is a block circuit diagram of a fourth embodiment of an analog display electronic timepiece according to the present invention, having two time indicating hands, and equipped with control circuit means functioning in response to the operation of an electromechanical transducer for controlling pulses input to a main and an auxiliary counter circuit.
Figure 15B:
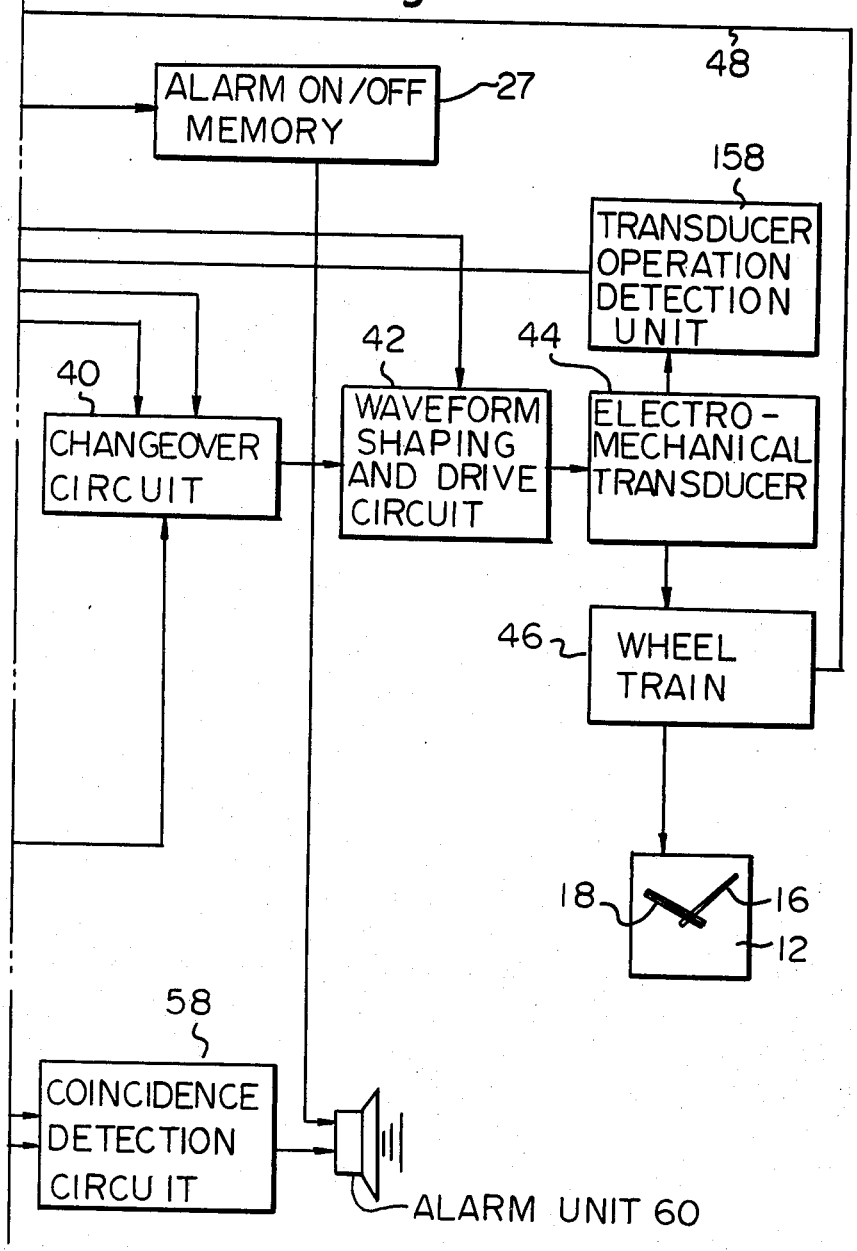

In the embodiment of FIG. 15, no seconds counter is provided, and unit time pulse having a period of 60 seconds are output by frequency divider circuit 29.

In the embodiment of FIG. 15, alarm time pulse control circuit 156 and timekeeping pulse control circuit 154 are shown as separate circuits. However, it is possible to combine these into a single circuit. In addition, it is possible to form transducer operation detection unit 158 as a part of waveform shaping and drive circuit 42.

Various systems are known in the prior art whereby the transducer operation detection unit 158 can be implemented. Such a system is described by Chihara et al, in U.S. Pat. No. 3,855,78. In the latter disclosure, means are disclosed whereby the position of the rotor of a stepping motor for use in an electronic timepiece can be detected, and signals thus generated used to determine the pulse width or the peak current value of drive pulses applied to the stepping motor. However it will be apparent that such means can be readily utilized to discriminate between a condition of correct rotation and incorrect rotation of the stepping motor rotor, as is required for the transducer operation detection unit 158 of the present invention.

Figure 18A:
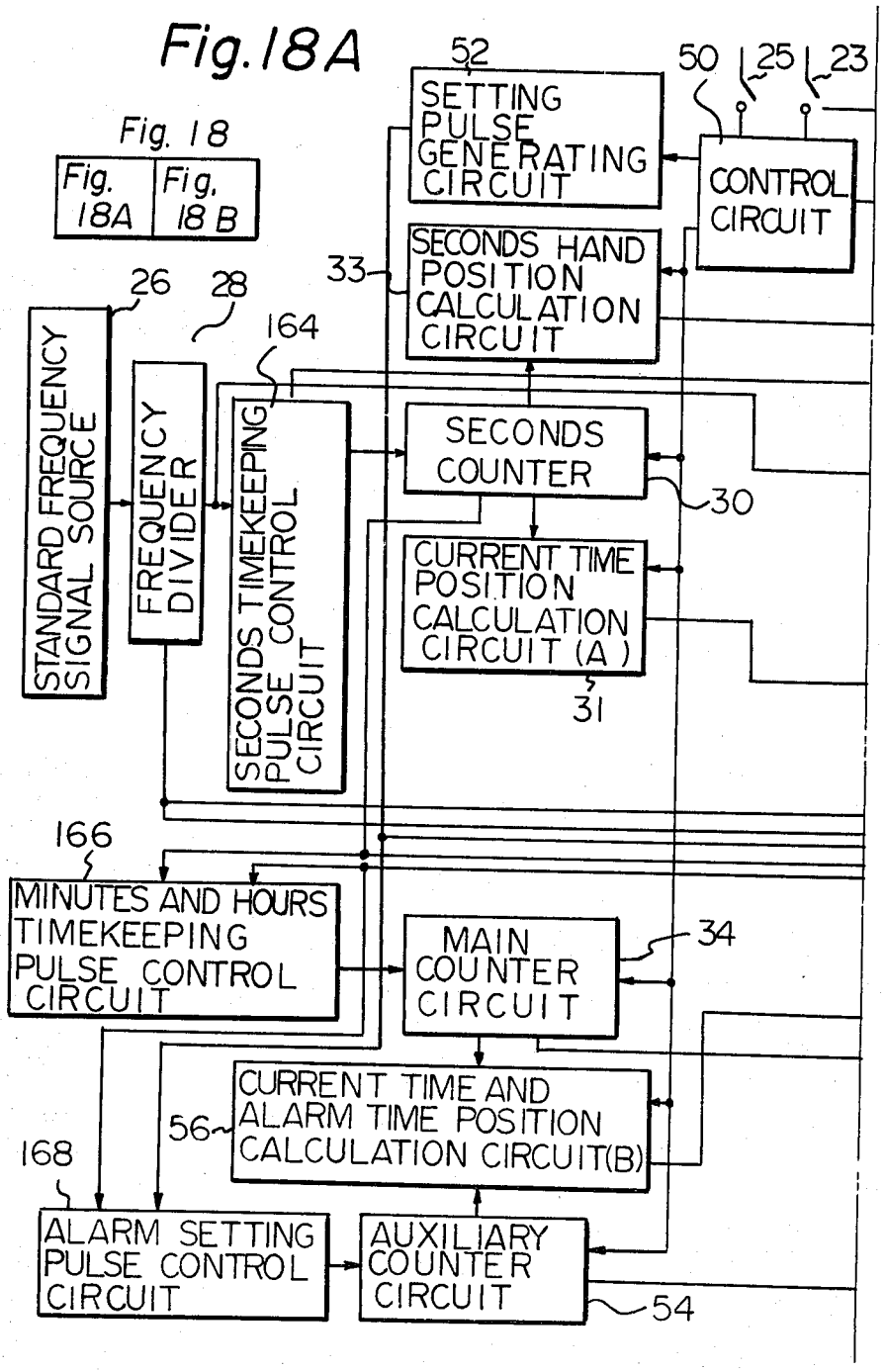
FIG. 18 is a block circuit diagram of a fifth embodiment of an analog display electronic timepiece according to the present invention, having three time indicating hands, which is a modification of the embodiment of FIG. 15.
Figure 18B:
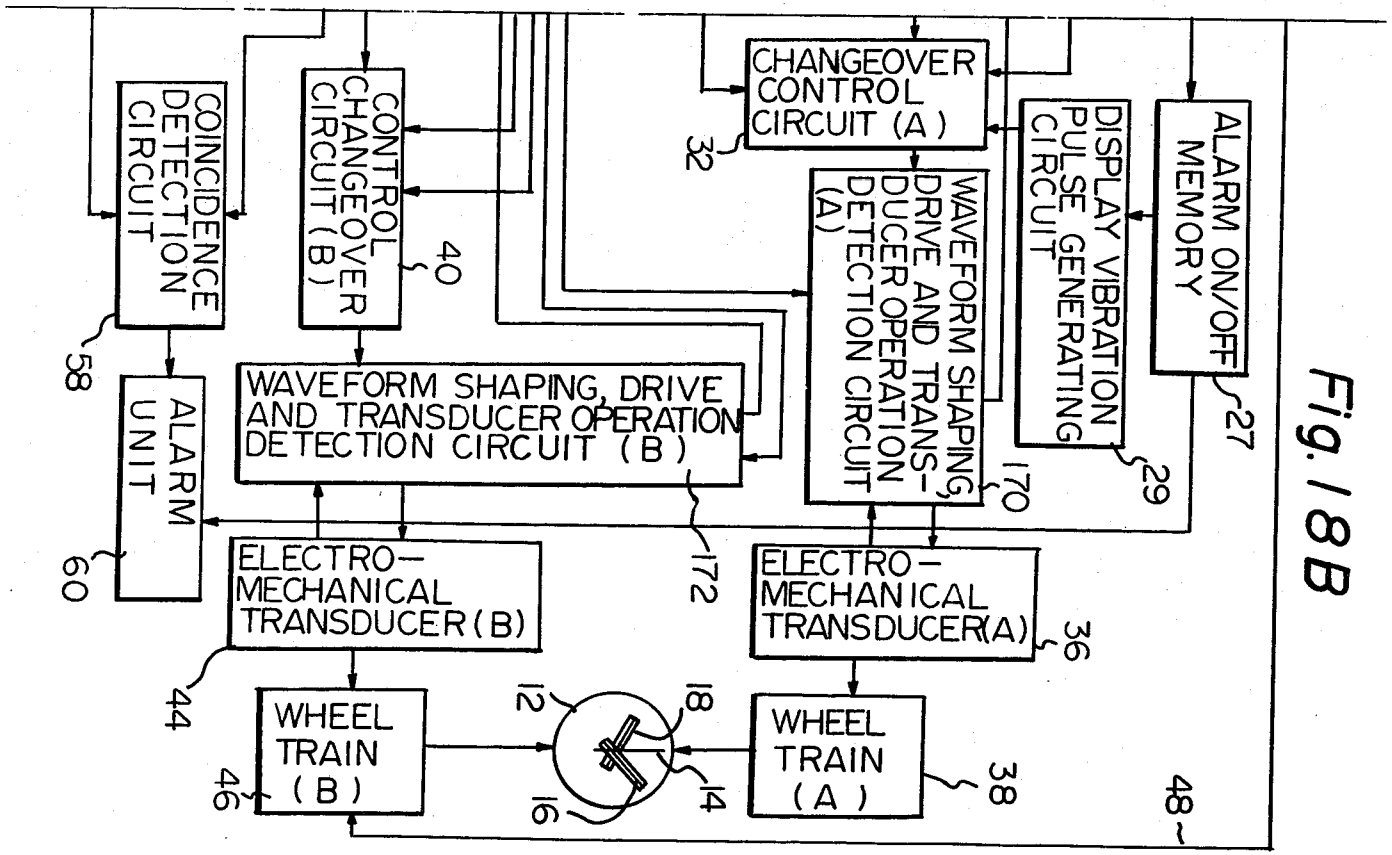

Referring now to FIG. 18, a fifth embodiment of the present invention will be described, which also provides the advantages described above for the fourth embodiment of FIG. 15. The embodiment of FIG. 15 is an analog display timepiece having three hands, which is similar to the first embodiment of FIG. 2. Circuit blocks indentical to those of FIG. 2 are identically numbered, and will not be further described. In this embodiment, the functions of waveform shaping and drive pulse generation and also of transducer operation detection are combined into single circuit blocks, i.e. waveform shaping, drive and transducer operation detection circuit (A) 170 and waveform shaping, drive and transducer operation detection circuit (B) 172. Transducer operation detection signals produced by waveform shaping, drive and transducer operation detection circuit (B) 172 serve to control the input of pulses to be counted by main counter circuit 34 and by auxiliary counter circuit 54, by means of a minutes and hours time-keeping pulse control circuit 166 and an alarm setting pulse control circuit 168, in exactly the same way as has been described for the embodiment of FIG. 15 described above. Similarly, when the timepiece is operating in the current time mode, so that seconds hand 14 is being periodically advance, the rotation of the rotor of stepping motor 36 is detected by is detected by waveform shaping, drive and transducer operation detection circuit (A) 170, which in response produces control signal pulses which are applied to seconds time-keeping pulse control circuit 164. In this way, a pulse is input to seconds counter circuit 30 for each correct rotation of the rotor of stepping motor 36, i.e. once per second if correct rotation is performed. This ensures that the contents of seconds counter circuit 30 are also advanced in synchronism with advancement of seconds hand 14, and also ensures that seconds hand 14 will always be precisely returned to the zero position each time changeover is performed from the current time mode to the alarm time mode, since the seconds counter transferred to seconds hand position calculation circuit 33 will always be correctly related to the position of seconds hand 14.

It should be noted that the embodiments of FIG. 15 and FIG. 18 can be adapted to provide for operation of the timepiece at the minimum possible level of stepping motor drive power. This can be done by providing circuit means for increasing the pulse width of the drive pulses applied to the stepping motors, when incorrect rotation of the rotors is detected by the transducer operation detection means, to a value at which correct operation of the stepping motors is assured. In this way, the pulse width of the drive pulses can be normally made of minimum duration, to reduce power consumption, and can be automatically increased only when necessary, due to some change in operating conditions for example.

Figure 19A:
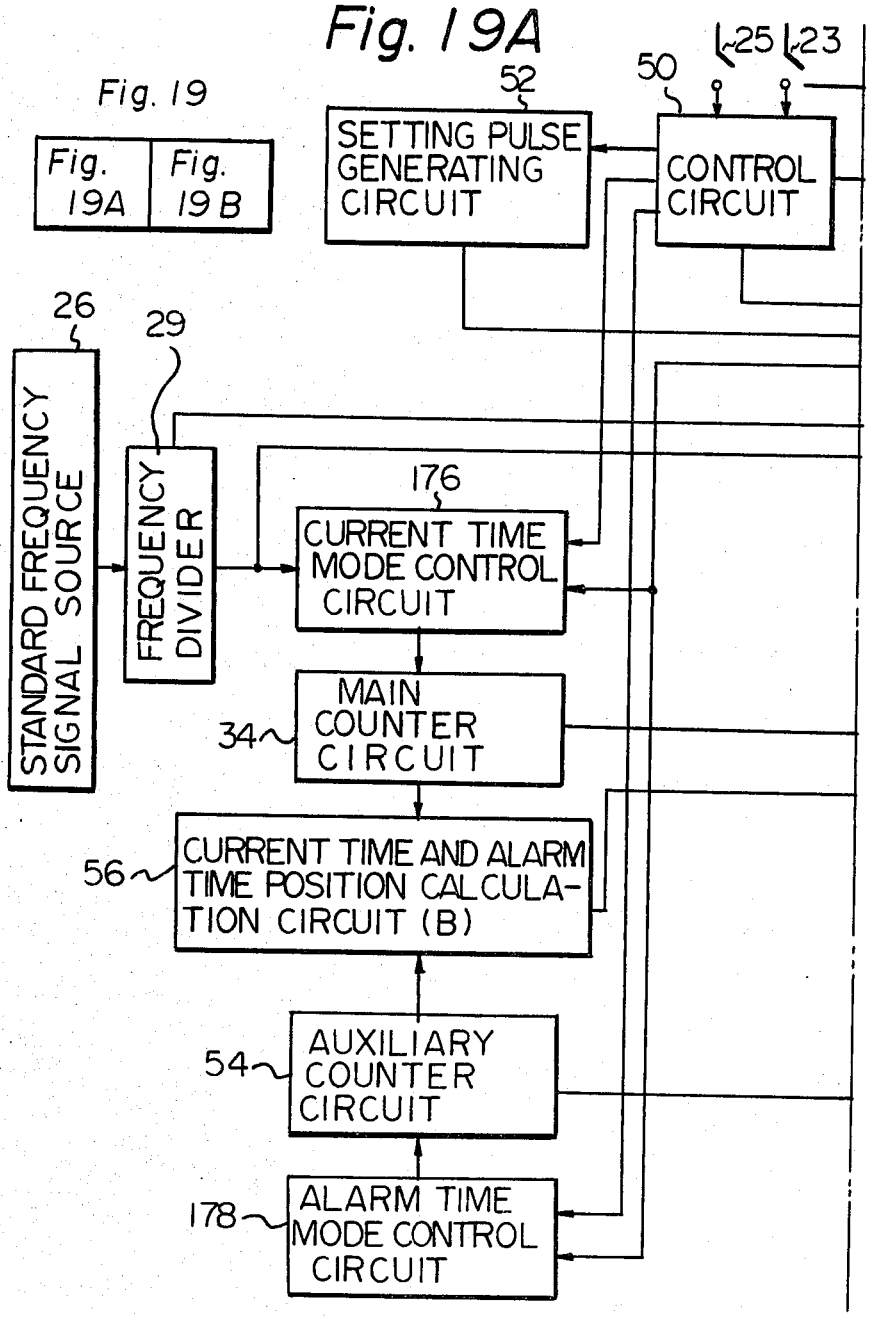
FIG. 19 is a block circuit diagram of a sixth embodiment of an analog display electronic timepiece according to the present invention, wherein signals produced by detection of operation of an timekeeping circuit electromechanical transducer are used to increment the contents of a main and an auxiliary counter circuit.
Figure 19B:
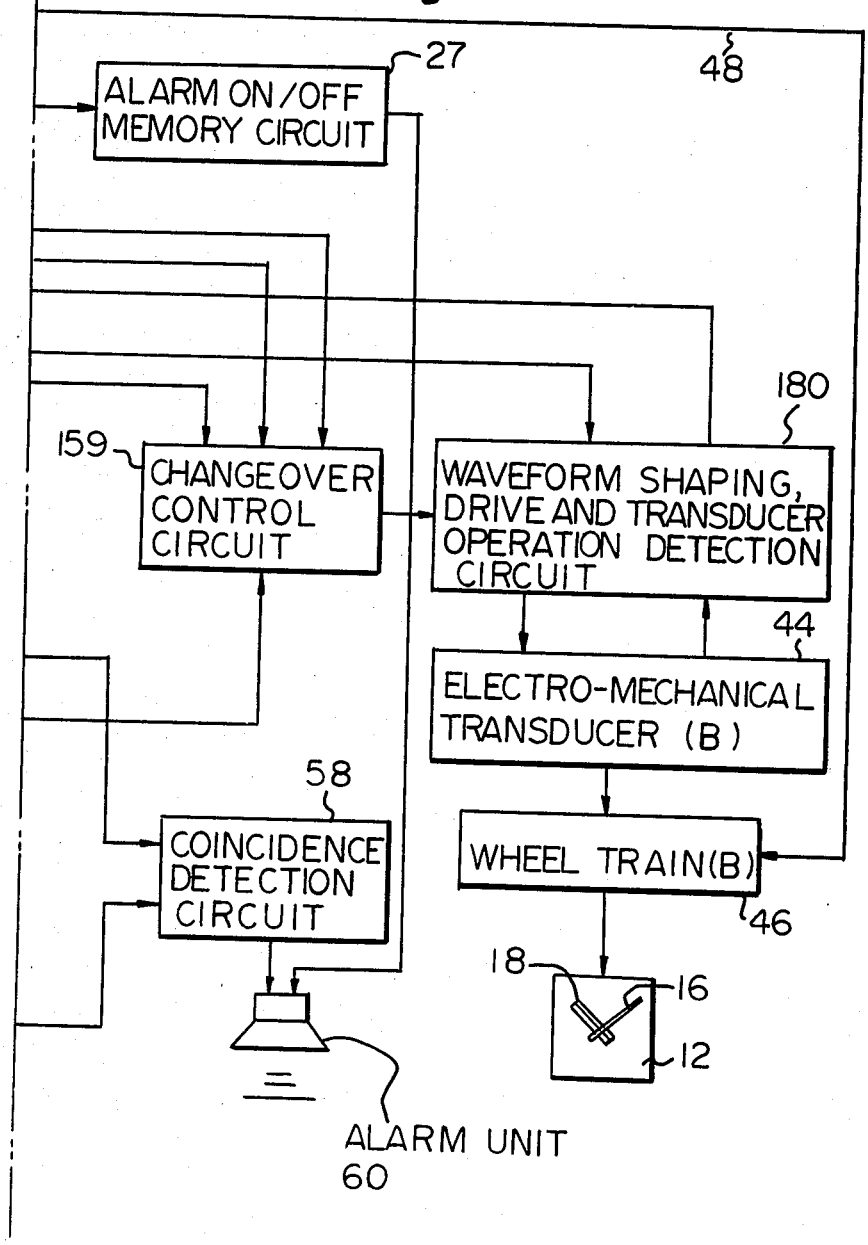

Another embodiment of the present invention is shown in the block circuit diagram of FIG. 19. This is an analog display timepiece having only two hands, as for the embodiment of FIG. 15, and which provides the advantages of the embodiments of FIG. 15 and FIG. 18, but by a different method. In FIG. 19, numeral 180 denotes a waveform shaping, drive and transducer operation detection circuit, which performs the function described above for waveform shaping, drive and transducer operation detection circuit (A) 170 in the embodiment of FIG. 18, i.e. producing drive pulses to actuate stepping motor 44 for thereby advancing minutes hand 16 and hours hand 18 through wheel train 46, and producing transducer operation detection pulses in accordance with whether the rotor of stepping motor 44 is correctly rotated. These transducer operation detection pulses are input to a current time mode control circuit 176, and an alarm time mode control circuit 178, which are controlled by signals applied from control circuit 50. Unit time signal pulses having a period of 60 seconds are input from frequency divider circuit 29 to current time mode control circuit 176 and to control changeover circuit 159. Transducer operation detection pulses from waveform shaping, drive and transducer operation detection circuit 180 are input to current time mode control circuit 176 and to alarm time mode control circuit 178.

The operation of the embodiment of FIG. 19 is as follows. In the current time mode, control signals from control circuit 50 cause the unit time signal from frequency divider 29 to be transferred by changeover control circuit 159 to waveform shaping, drive and transducer operation detection circuit 180, which in response produces drive pulses having a 60 seconds period. Each time the rotor of stepping motor 44 is correctly rotated by such a drive pulse, then a transducer operation detection pulse from waveform shaping, drive and transducer operation detection circuit 180, and input through current time mode control circuit 176 to main counter circuit 34. If on the other hand the rotor of stepping motor 44 is not correctly rotated by a drive pulse, then this is detected by waveform shaping, drive and transducer operation detection circuit 180, causing the corresponding transducer operation detection pulse to be omitted. Thus in this case, current time mode control circuit 176 is inhibited from applying a pulse to be counted by main counter circuit 34. The contents of main counter circuit 34 and the time displayed by analog display section 12 will therefore be kept in correspondence, in the event of sporadic misoperation of stepping motor 44.

In the alarm time mode, setting pulses from setting pulse generating circuit 52 are applied through changeover control circuit 159 to waveform shaping, drive and transducer operation detection circuit 180, so that drive pulses for setting an alarm time are output therefrom, in response to rotation of crown 22. If stepping motor 44 is correctly driven, then transducer operation detection pulses from waveform shaping, drive and transducer operation detection circuit 180 cause corresponding pulses to be input by alarm time mode control circuit 178 to be counted by auxiliary counter circuit 54. If stepping motor 44 fails to rotate correctly, then input of pulses to be counted by auxiliary counter circuit 54 is correspondingly inhibited by alarm time mode control circuit 178, as in the case of current time mode operation described above. Thus, one pulse will be input to be counted by auxiliary counter circuit 54 for each drive pulse which correctly rotates the rotor of stepping motor 44, in the alarm time mode. As a result, the alarm time indicated by analog display section 12 will always correspond with the contents of auxiliary counter circuit 54, when alarm time setting is performed. Furthermore, in the alarm time mode, current time mode control circuit 176 is responsive to control signals from control circuit 50 for transferring unit time signal pulses from frequency divider circuit 29 to be counted by main counter circuit 34, in place of transducer operation detection pulses. The contents of main counter circuit 34 therefore continue to be correctly updated while the timepiece is in the alarm time mode. It should be noted that, although in the description of the preferred embodiments, electromagnetic transducers capable of bidirectional are described, this is not an essential feature of the present invention, but only serves to maximize the speed of changeover of analog display information.

From the above, it can be understood that an analog display electronic timepiece according to the present invention can provide operation in a plurality of function modes, including a current time mode, utilizing very simple circuit means, based upon the concept of utilizing a main counter circuit whose contents are updated in synchronism with advancement of the timepiece hands but whose operation is independent of the circuit means for advancing the hands, an auxiliary counter circuit in which data relating to another function mode other than the current time mode (e.g. an alarm time mode), and circuit means responsive to the contents of the main and auxiliary counters for producing a group of pulses, whenever changeover is performed between function modes, whereby the hands of the timepiece are rapidly driven to indicate information corresponding to the new function mode . In addition, as described in the preferred embodiments, one of the hands (e.g. the seconds hand) can be moved in a distinctive fashion, when changeover is performed between function modes, in such a way as to positively indicate to the user that such a changeover has been accomplished. In addition, circuit means can be provided whereby, when an electromagnetic transducer used to drive the hands of such a timepiece comprises an ultra-miniature stepping motor, and when the rotor of such a stepping motor occasionally fails to rotate correctly in response to drive pulses applied to the motor, counting operations by the main or auxiliary counter circuits are held accurately in synchronism with advancement of the timepiece hands by such a stepping motor.

Although the present invention has been shown and described with reference to specific embodiments, it should be noted that various changes and modifications to these embodiments are possible, which fall within the scope claimed for the present invention. The described embodiments should therefore be interpreted in an illustrative, and not in a limiting sense. The scope claimed for the present invention is given by the appended claims.

What is claimed is:

1. An analog display electronic timepiece provided with an alarm function and adapted to selectively indicate current time and a preset alarm time, comprising:

a standard frequency signal source for providing a standard frequency signal of relatively high frequency;

a frequency divider circuit responsive to said standard frequency signal for producing a first unit time signal having a period of one second and for producing a second unit time signal having a period which is an integral multiple of one second;

first drive circuit means responsive to said second unit time signal for producing a first drive signal;

a first electromagnetic transducer coupled to be driven by said first drive signal;

a first wheel train coupled to be driven by said first electromagnetic transducer;

a minutes hand coupled to said first wheel train to be advanced a predetermined number of times per minute;

an hours hand coupled to said first wheel train to be rotated thereby;

second drive circuit means responsive to said first unit time signal for producing a second drive signal;

a second electromagnetic transducer coupled to be driven by said second drive signal;

a second wheel train coupled to be driven by said second electromagnetic transducer;

a seconds hand coupled to said second wheel train to be rotated thereby;

externally operable switch means;

control circuit means responsive to actuation of said externally operable switch means for producing a plurality of control signals including alarm setting signals for selectively setting said timepiece in a current time mode and in an alarm time mode of operation;

calculation and counter circuit means for counting and memorizing said second unit time signal and said alarm setting signal, for thereby producing a first rapid advancement signal when said timepiece is changed over from operation in said current time mode to said alarm time mode, and for producing a second rapid advancement signal when said timepiece is changed over from operation in said alarm time mode to said current time mode, and further for producing an alarm detection signal when the difference between said preset alarm time and current time becomes zero;

alarm means responsive to said alarm detection signal for producing an audible alarm signal;

changeover cotrol circuit means responsive to said control signal from said control circuit means for selectively transferring said second unit time signal to said first drive circuit means during said current time mode and for transferring said first rapid advancement signal to said first drive circuit means when changeover is performed from said current time mode to said alarm time mode, and further for transferring said second rapid advancement signal to said first drive circuit when changeover is performed from said alarm time mode to said current time mode; and analog display means including a minutes hand and an hours hand coupled to be rotated by said first electromagnetic transducer and a seconds hand coupled to be rotated by said second electromagnetic transducer, said hours hand and minutes hand being thereby rapidly driven to indicate said preset alarm time when changeover is performed from said current time mode to said alarm time mode and being rapidly driven to indicate current time when changeover is performed from said alarm time mode to said current time mode, with said seconds hand being driven independently from said hours and minutes hands during said mode changeovers;

seconds hand position counter circuit means for counting said first unit time signal and for producing a third rapid advancement signal when said timepiece is changed over from operation in said current time mode to said alarm time mode and for producing a fourth rapid advancement signal when said timepiece is changed over from operation in said alarm time mode to said current time mode in response to said control signals from said control circuit means;

said second driver circuit means being further responsive to said third and fourth rapid advancement signals for producing third and fourth rapid advancement drive signals;

whereby said seconds hand is driven to a zero seconds indicating position when changeover is performed from said current time mode to said alarm time mode, and is rapidly driven to a position indicating current time seconds information when changeover is performed from said alarm time mode to said current time mode and is thereafter periodically advanced in response to said first unit time signal;

alarm memory circuit means and display vibration signal generating circuit means;

said alarm memory circuit means being responsive to a predetermined one of said control signals from said control circuit means for being selectively set to a first condition in which an alarm output enabling signal is generated thereby and a second condition in which an alarm output inhibiting signal is generated thereby, said alarm means being responsive to said alarm output enabling signal for generating said audible alarm signal when said coincidence detection is produced, and is inhibited from generating said audible alarm signal by said alarm output inhibiting signal;

said display vibration signal generating circuit means being responsive to said alarm output enabling signal for generating a display vibration signal, said changeover control circuit means being responsive to said control signals for transferring said display vibration signal to be input to said second drive circuit means during said alarm time mode to produce a drive signal therefrom, said second electromagnetic transducer being responsive to said drive signal for rotationally vibrating said second electromagnetic transducer about a fixed position, and said rotational vibration being transmitted by said second wheel train to said seconds hand whereby said seconds hand is rotationally vibrated about said zero seconds indicating position for thereby providing an indication that said timepiece is in said alarm time mode and in a state in which emission of said audible alarm signal is enabled.

2. An analog display electronic timepiece according to claim 1, in which said counter circuit means comprises a counter circuit for counting and memorizing a difference between said preset alarm time and current time, said counter circuit being responsive to a predetermined one of said control signals from said control circuit means for being reset to a predetermined initial count value.

3. An analog display electronic timepiece according to claim 2, in which said electromagnetic transducer includes a rotor, and in which said electromagnetic transducer is controlled by said drive signals for selectively rotating said rotor in a forward direction and in a reverse direction, to thereby rotate said minutes and hours hands in a clockwise direction and in a counterclockwise direction respectively.

4. An analog display electronic timepiece according to claim 1, and further comprising timing circuit means responsive to said control signals from said control circuit means for determining the timing of output of rapid advancement pulses by said calculation and counter circuit means and by said seconds hand position counter circuit means such that when changeover is performed from said current time mode to said alarm time mode, a first group of rapid advancement pulses is generated by one of said calculation and counter circuit means and said second hand position counter circuit means, and whereby subsequent to completion of generation of said first group of rapid advancement pulses, a second group of rapid advancement pulses is then generated by the other one of said calculation and counter circuit means and said second hand position counter circuit means.

5. An analog display electronic timepiece according to claim 4, in which said first group of rapid advancement pulses is first generated by said second hand position counter means, whereby said seconds hand is rapidly driven to the zero seconds position when changeover is performed from said current time mode to said alarm time mode and subsequently said hours and minutes hands are driven to indicate said preset alarm time.

6. An analog display electronic timepiece according to claim 4, in which said timing circuit means for rapid advancement pulses output timing determination comprises remaining pulse detection circuit means for detecting when all of said first group of pulses have been fully generated and responsive to such detection for producing a signal activating the generation of said second group of rapid advancement pulses.

7. An analog display electronic timepiece according to claim 4, in which said timing circuit means for rapid advancement pulse output timing determination comprises a timer circuit coupled to be triggered by one of said control signals which initiates generation of said first group of rapid advancement pulses, said timer circuit thereby producing an output signal after a predetermined time interval whereby generation of said second group of rapid advancement pulses is initiated.

* * * * *